US010655203B2

(12) United States Patent
Mitsunobu

(10) Patent No.: US 10,655,203 B2
(45) Date of Patent: May 19, 2020

(54) PLATED STEEL SHEET

(71) Applicant: NIPPON STEEL & SUMITOMO METAL CORPORATION, Tokyo (JP)

(72) Inventor: Takuya Mitsunobu, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 276 days.

(21) Appl. No.: 15/753,150

(22) PCT Filed: Oct. 25, 2016

(86) PCT No.: PCT/JP2016/081634
§ 371 (c)(1),
(2) Date: Feb. 15, 2018

(87) PCT Pub. No.: WO2017/073579
PCT Pub. Date: May 4, 2017

(65) Prior Publication Data

US 2018/0245193 A1 Aug. 30, 2018

(30) Foreign Application Priority Data

Oct. 26, 2015 (JP) ..... 2015-209674

(51) Int. Cl.
*C23C 2/06* (2006.01)
*C22C 18/04* (2006.01)
*C23C 2/40* (2006.01)

(52) U.S. Cl.
CPC ..... *C23C 2/06* (2013.01); *C22C 18/04* (2013.01); *C23C 2/40* (2013.01)

(58) Field of Classification Search
None
See application file for complete search history.

(56) References Cited

U.S. PATENT DOCUMENTS

2005/0123786 A1 6/2005 Honda et al.
2009/0004400 A1 1/2009 Ranjan et al.
2012/0070687 A1 3/2012 Shimoda et al.

FOREIGN PATENT DOCUMENTS

AU 2010267413 A1 2/2012
EP 1489195 A1 12/2004
(Continued)

OTHER PUBLICATIONS

Notification of Transmittal of Translation of the International Preliminary Report on Patentability; International Preliminary Report on Patentability (Form PCT/IB/373); English translation of Written Opinion of the International Searching Authority (Form PCT/ISA/237) for PCT/JP2016/081634, dated May 11, 2018.
(Continued)

*Primary Examiner* — Adam Krupicka
(74) *Attorney, Agent, or Firm* — Birch, Stewart, Kolasch & Birch, LLP

(57) ABSTRACT

An average chemical composition of a plating layer (10) and an intermetallic compound layer (30) is represented by, in terms of mass %, Al: 10% to 40%, Si: 0.05% to 4%, Mg: 0% to 5%, and the balance: Zn and impurities. The plating layer (10) includes a first structure (11) constituted from Al phases containing Zn in solid solution and Zn phases dispersed in the Al phases and having an average chemical composition represented by, in terms of mass %, Al: 25% to 50%, Zn: 50% to 75%, and impurities: less than 2%, and a eutectoid structure (14) constituted from Al phases and Zn phases and having an average chemical composition represented by, in terms of mass %, Al: 10% to 24%, Zn: 76% to 90%, and impurities: less than 2%. In a cross section of the plating layer (10), an area fraction of the first structure (11) is 5% to 40% and a total area fraction of the first structure (11) and the eutectoid structure (14) is 50% or more, an area fraction of Zn phases (15) which are structures containing 90% or
(Continued)

more of Zn, contained in the plating layer (10) is 25% or less, a total area fraction of intermetallic compound phases contained in the plating layer (10) is 9% or less, and a thickness of the intermetallic compound layer (30) is 2 μm or less.

9 Claims, 6 Drawing Sheets

(56) References Cited

FOREIGN PATENT DOCUMENTS

| | | | |
|---|---|---|---|
| EP | 1557478 | A1 | 7/2005 |
| JP | 2002-206156 | A | 7/2002 |
| JP | 2003-155549 | A | 5/2003 |
| JP | 2003-253416 | A | 9/2003 |
| JP | 2003-268517 | A | 9/2003 |
| JP | 2004-323974 | A | 11/2004 |
| JP | 2004-338397 | A | 12/2004 |
| JP | 2005-154856 | A | 6/2005 |
| JP | 2005-336546 | A | 12/2005 |
| JP | 2006-22363 | A | 1/2006 |
| JP | 2006-193791 | A | 7/2006 |
| JP | 2006-348332 | A | 12/2006 |
| JP | 2010-229483 | A | 10/2010 |
| WO | WO 2010/150537 | A1 | 12/2010 |
| WO | WO 2011/001662 | A1 | 1/2011 |

OTHER PUBLICATIONS

Second and Supplementary Notice Informing the Applicant of the Communication of the International Application for PCT/JP2016/081634, dated Mar. 1, 2018.

International Search Report for PCT/JP2016/081634 dated Dec. 13, 2016.

Written Opinion of the International Searching Authority for PCT/JP2016/081634 (PCT/ISA/237) dated Dec. 13, 2016.

Extended European Search Report, dated May 21, 2019, for corresponding European Application No. 16859809.2.

PLATED STEEL SHEET

TECHNICAL FIELD

The present invention relates to a plated steel sheet including an Al-containing Zn-based plating layer on at least a part of a surface of a steel sheet.

BACKGROUND ART

A plated steel sheet has been used as a structural member of an automobile from a viewpoint of rust prevention. As a plated steel sheet for automobile, there can be cited an alloyed galvanized steel sheet and a hot-dip galvanized steel sheet, for example.

The alloyed galvanized steel sheet has an advantageous point that it is excellent in weldability and corrosion resistance after coating. One example of the alloyed galvanized steel sheet is described in Patent Literature 1. However, a plating layer of the alloyed galvanized steel sheet is relatively hard due to diffusion of Fe which occurs at a time of alloying treatment, so that it is easily peeled off when compared to a plating layer of the hot-dip galvanized steel sheet. Specifically, a crack is likely to occur in the plating layer due to an external pressure, the crack propagates up to an interface between the plating layer and a base steel sheet, and the plating layer is likely to peel off from the interface as a starting point. For this reason, when the alloyed galvanized steel sheet is used as an outer panel of an automobile, there is a case where a collision of small stones (chipping) due to stone splash with respect to a traveling vehicle occurs, resulting in that a plating layer is peeled off together with a coating, and a base steel sheet is exposed and is likely to be corroded. Further, the plating layer of the alloyed galvanized steel sheet contains Fe, so that when the coating is peeled off due to the chipping, the plating layer itself is corroded, and a reddish-brown rust is sometimes generated. There is also a case where powdering and flaking occur in the plating layer of the alloyed galvanized steel sheet.

The plating layer of the hot-dip galvanized steel sheet which is not subjected to the alloying treatment does not contain Fe, and thus is relatively soft. For this reason, with the use of the hot-dip galvanized steel sheet, it is possible to make it difficult to cause corrosion accompanied by the chipping, and it is also possible to suppress the powdering and the flaking. One example of the hot-dip galvanized steel sheet is described in each of Patent Literatures 2 to 5. However, because of a low melting point of the plating layer of the hot-dip galvanized steel sheet, seizing with respect to a metal mold is likely to occur at a time of press forming. Further, there is also a case where a crack occurs in the plating layer at a time of the press forming and bending.

As described above, in the conventional plated steel sheets, it cannot be said that all of a powdering resistance, a seizing resistance, a crack resistance, and a chipping resistance are suitable for the application of an automobile.

CITATION LIST

Patent Literature

Patent Literature 1: Japanese Laid-open Patent Publication No. 2003-253416

Patent Literature 2: Japanese Laid-open Patent Publication No. 2006-348332

Patent Literature 3: Japanese Laid-open Patent Publication No. 2005-154856

Patent Literature 4: Japanese Laid-open Patent Publication No. 2005-336546

Patent Literature 5: Japanese Laid-open Patent Publication No. 2004-323974

SUMMARY OF INVENTION

Technical Problem

The present invention has an object to provide a plated steel sheet capable of obtaining an excellent chipping resistance, and capable of suppressing powdering and seizing with respect to a metal mold at a time of press forming and an occurrence of crack at a time of working.

Solution to Problem

The present inventors conducted earnest studies in order to solve the above-described problems. As a result of this, they found out that when a plating layer is provided with a predetermined chemical composition and predetermined structures, it is possible to obtain an excellent chipping resistance, and it is possible to suppress powdering and seizing with respect to a metal mold at a time of press forming and an occurrence of crack at a time of working. Hereinafter, a plastic deformability, a seizing resistance, and a powdering resistance are sometimes named generically as workability. Further, the present inventors also found out that the aforementioned predetermined structures cannot be obtained by a conventional manufacturing method of a plated steel sheet, and the predetermined structures can be obtained when a plated steel sheet is manufactured through a method different from the conventional method. Based on such findings, the present inventors arrived at various embodiments of the invention to be described below.

(1)

A plated steel sheet is characterized in that it includes an Al-containing Zn-based plating layer on at least a part of a surface of a steel sheet, in which an average chemical composition of the plating layer and an intermetallic compound layer between the plating layer and the steel sheet is represented by, in terms of mass %, Al: 10% to 40%, Si: 0.05% to 4%, Mg: 0% to 5%, and the balance: Zn and impurities, the plating layer includes a first structure constituted from Al phases containing Zn in solid solution and Zn phases dispersed in the Al phases and having an average chemical composition represented by, in terms of mass %, Al: 25% to 50%, Zn: 50% to 75%, and impurities: less than 2%, and a eutectoid structure constituted from Al phases and Zn phases and having an average chemical composition represented by, in terms of mass %, Al: 10% to 24%, Zn: 76% to 90%, and impurities: less than 2%, in a cross section of the plating layer, an area fraction of the first structure is 5% to 40%, and a total area fraction of the first structure and the eutectoid structure is 50% or more, an area fraction of Zn phases which are structures containing 90% or more of Zn, contained in the plating layer is 25% or less, a total area fraction of intermetallic compound phases contained in the plating layer is 9% or less, and a thickness of the intermetallic compound layer is 2 μm or less.

(2)

The plated steel sheet described in (1) is characterized in that a number density of the first structure on a surface of the plating layer is 1.6 pieces/$cm^2$ to 25.0 pieces/$cm^2$.

(3)

The plated steel sheet described in (1) or (2) is characterized in that the first structure includes a second structure having an average chemical composition represented by, in terms of mass %, Al: 37% to 50%, Zn: 50% to 63%, and impurities: less than 2%, and a third structure having an average chemical composition represented by, in terms of mass %, Al: 25% to 36%, Zn: 64% to 75%, and impurities: less than 2%.

(4)

The plated steel sheet described in any of (1) to (3) is characterized in that the average chemical composition of the plating layer and the intermetallic compound layer is represented by, in terms of mass %, Al: 20% to 40%, Si: 0.05% to 2.5%, Mg: 0% to 2%, and the balance: Zn and impurities.

(5)

The plated steel sheet described in any of (1) to (4) is characterized in that the thickness of the intermetallic compound layer is 100 nm to 1000 nm.

(6)

The plated steel sheet described in any of (1) to (5) is characterized in that in the cross section of the plating layer, the area fraction of the first structure is 20% to 40%, the area fraction of the eutectoid structure is 50% to 70%, and the total area fraction of the first structure and the eutectoid structure is 90% or more.

(7)

The plated steel sheet described in any of (1) to (6) is characterized in that in the cross section of the plating layer, the area fraction of the first structure is 30% to 40%, the area fraction of the eutectoid structure is 55% to 65%, and the total area fraction of the first structure and the eutectoid structure is 95% or more.

(8)

The plated steel sheet described in any of (1) to (7) is characterized in that in the average chemical composition of the plating layer and the intermetallic compound layer, the Mg concentration is 0.05% to 5%, when the Mg concentration is set to Mg % and the Si concentration is set to Si %, a relationship of "Mg %≤2×Si %" is satisfied, and a crystal of $Mg_2Si$ which exists in the plating layer is 2 μm or less in terms of maximum equivalent circle diameter.

(9)

The plated steel sheet described in any of (1) to (8) is characterized in that a volume fraction of the Zn phases contained in the plating layer is 20% or less.

Advantageous Effects of Invention

According to the present invention, a plating layer is provided with predetermined chemical composition and structures, and thus it is possible to obtain an excellent chipping resistance, and suppress powdering and seizing with respect to a metal mold at a time of press forming and an occurrence of crack at a time of working.

DESCRIPTION OF EMBODIMENTS

Figure 1:
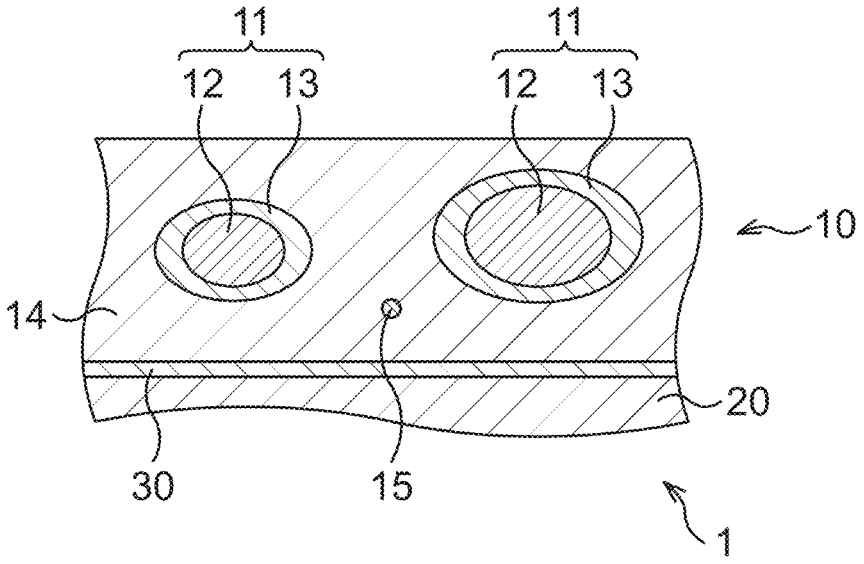
FIG. 1 is a sectional view illustrating one example of a plating layer included in a plated steel sheet according to an embodiment of the present invention.

Hereinafter, embodiments of the present invention will be described. A plated steel sheet according to the present embodiment relates to a plated steel sheet including an Al-containing Zn-based plating layer on at least a part of a surface of a steel sheet.

First, an average chemical composition of a plating layer and an intermetallic compound layer between the plating layer and a steel sheet will be described. In the description hereinbelow, "%" being a unit of concentration of each element means "mass %" unless otherwise noted. The average chemical composition of the plating layer and the intermetallic compound layer included in the plated steel sheet according to the present embodiment is represented by Al: 10% to 40%, Si: 0.05% to 4%, Mg: 0% to 5%, and the balance: Zn and impurities.

(Al: 10% to 40%)

Al contributes to increase in a melting point and improvement of hardness of an Al-containing Zn-based plating layer. As the melting point of the plating layer increases, seizing at a time of press forming becomes difficult to occur. When an Al concentration is less than 10%, the melting point of the plating layer does not become higher than a melting point of a plating layer composed of pure Zn, resulting in that the seizing cannot be sufficiently suppressed. Therefore, the Al concentration is set to 10% or more, and preferably set to 20% or more. When the Al concentration is 10% or more, the higher the Al concentration, the higher a melting point of a Zn—Al alloy, and a melting point of a Zn—Al alloy whose Al concentration is about 40% is about 540° C.

Al can also contribute to improvement of ductility of the Al-containing Zn-based plating layer. By the studies conducted by the present inventors, it has been clarified that the ductility of the Al-containing Zn-based plating layer is particularly excellent when the Al concentration is 20% to 40%, but, it is lower than the ductility of the plating layer composed of pure Zn when the Al concentration is less than 5% or greater than 40%. Therefore, the Al concentration is set to 40% or less.

(Si: 0.05% to 4%)

Si suppresses a reaction between Zn and Al contained in a plating bath and Fe contained in a steel sheet being a plating original sheet at a time of forming a plating layer, to thereby suppress generation of an intermetallic compound layer at a position between the plating layer and the steel sheet. Although details will be described later, the intermetallic compound layer contains an Al—Zn—Fe compound, for example, and is also called as an interface alloy layer, which reduces adhesiveness between the plating layer and the steel sheet and reduces the workability. When a concentration of Si contained in the plating bath is less than 0.05%, the intermetallic compound layer starts to grow immediately after the plating original sheet is immersed into the plating bath, resulting in that the intermetallic compound layer is excessively formed, and the reduction in the workability becomes significant. Therefore, the Si concentration in the plating bath is set to 0.05% or more, and an average Si concentration in the plating layer and the intermetallic compound layer is also set to 0.05% or more. On the other hand, when the Si concentration is greater than 4%, a Si phase to be a starting point of fracture is likely to remain in the plating layer, and it is sometimes impossible to obtain sufficient ductility. Therefore, the Si concentration is set to 4% or less, and preferably set to 2% or less.

(Mg: 0% to 5%)

Mg contributes to improvement of corrosion resistance after coating. For example, when Mg is contained in the plating layer, even if there is a cut in a coating film and the plating layer, it is possible to suppress corrosion which occurs from the cut. This is because, since Mg is eluted in accordance with the corrosion, a corrosion product containing Mg is generated around the cut, which performs an action, such as a self-repair action, to prevent further entrance of a corrosion factor such as water and oxygen from the cut. The effect of suppressing the corrosion is significant when a Mg concentration is 0.05% or more. Therefore, the Mg concentration is preferably 0.05% or more, and more preferably 1% or more. On the other hand, Mg is likely to form an intermetallic compound which is poor in the workability such as $MgZn_2$ or $Mg_2Si$. When Si is contained in the plating layer, $Mg_2Si$ tends to precipitate more preferentially than $MgZn_2$. As these intermetallic compounds increase, the workability decreases, and when the Mg concentration exceeds 5%, the reduction in the ductility of the plating layer is significant. Therefore, the Mg concentration is set to 5% or less, and preferably set to 2% or less.

When a relationship of "Mg %>2×Si %" in which the Mg concentration is set to "Mg %" and the Si concentration is set to "Si %" is satisfied, $MgZn_2$ having the workability lower than that of $Mg_2Si$ is preferentially generated. Therefore, it is preferable that even if the Mg concentration is 5% or less, a relationship of "Mg %≤2×Si %" is satisfied. A $Mg_2Si$ phase and a $MgZn_2$ phase are examples of other intermetallic compound phases.

(Balance: Zn and Impurities)

Zn contributes to improvement of a sacrificial corrosion-proof performance and the corrosion resistance of the plating layer, and a performance of a coating base. It is preferable that Al and Zn make up most of the plating layer. As the impurities, there can be cited Fe diffused from the steel sheet, and elements which are inevitably contained in the plating bath, for example.

Next, a structure of the plating layer will be described. FIG. 1 is a sectional view illustrating one example of a plating layer included in a plated steel sheet according to an embodiment of the present invention. A plating layer 10 included in a plated steel sheet 1 according to the present embodiment includes a first structure 11 constituted from Al phases containing Zn in solid solution and Zn phases dispersed in the Al phases and having an average chemical composition represented by Al: 25% to 50%, Zn: 50% to 75%, and impurities: less than 2%, and a eutectoid structure 14 constituted from Al phases and Zn phases and having an average chemical composition represented by Al: 10% to 24%, Zn: 76% to 90%, and impurities: less than 2%. In a cross section of the plating layer 10, an area fraction of the first structure 11 is 5% to 40% and a total area fraction of the first structure 11 and the eutectoid structure 14 is 50% or more, an area fraction of Zn phases 15 which are structures containing 90% or more of Zn, contained in the plating layer 10 is 25% or less, a total area fraction of intermetallic compound phases contained in the plating layer 10 is 9% or less, and a thickness of an intermetallic compound layer 30 between the plating layer 10 and a steel sheet 20 is 2 μm or less.

(First Structure)

The first structure is a structure constituted from Al phases containing Zn in solid solution and Zn phases dispersed in the Al phases and having an average chemical composition represented by Al: 25% to 50%, Zn: 50% to 75%, and impurities: less than 2%. The first structure contributes to improvement of a plastic deformability, workability, and a chipping resistance. When an area fraction of the first structure is less than 5% in a cross section of the plating layer, sufficient workability cannot be obtained. Therefore, the area fraction of the first structure is set to 5% or more, more preferably set to 20% or more, and still more preferably set to 30% or more. On the other hand, the area fraction of the first structure capable of being formed by a method to be described later is 40% at the maximum.

As illustrated in FIG. 1, the first structure 11 includes, for example, a second structure 12 and a third structure 13. The second structure is a structure having an average chemical composition represented by Al: 37% to 50%, Zn: 50% to 63%, and impurities: less than 2%. The third structure is a structure having an average chemical composition represented by Al: 25% to 36%, Zn: 64% to 75%, and impurities: less than 2%. Each of the second structure and the third structure is constituted from Al phases containing Zn in solid solution and Zn phases dispersed in the Al phases. Although details will be described later, a proportion of the second structure and the third structure in the plating layer can be determined from a backscattered electron (BSE) image obtained by a scanning electron microscope (SEM), by utilizing image processing.

(Eutectoid Structure)

The eutectoid structure is a structure constituted from Al phases and Zn phases and having an average chemical composition represented by Al: 10% to 24%, Zn: 76% to 90%, and impurities: less than 2%. The eutectoid structure also contributes to the improvement of the plastic deformability. When an area fraction of the eutectoid structure is less than 50% in the cross section of the plating layer, a proportion of Zn phases becomes high, and there is a case where sufficient press formability and corrosion resistance after coating cannot be obtained. Therefore, the area fraction of the eutectoid structure is preferably set to 50% or more, and more preferably set to 55% or more. On the other hand, the area fraction of the eutectoid structure capable of being formed by the method to be described later is 75% at the maximum. In order to obtain the first structure, which is likely to contribute more than the eutectoid structure to the improvement of the workability, at a higher area fraction, the area fraction of the eutectoid structure is preferably set to 70% or less, and more preferably set to 65% or less.

When a total area fraction of the first structure and the eutectoid structure is less than 50% in the cross section of the plating layer, sufficient plastic deformability cannot be obtained. For example, when complicated press forming is performed, a lot of cracks sometimes occur. Therefore, the total area fraction of the first structure and the eutectoid structure is set to 50% or more. Further, the first structure possesses a plastic deformability which is better than that of the eutectoid structure, so that the area fraction of the first structure is preferably higher than the area fraction of the eutectoid structure.

Figure 2A:
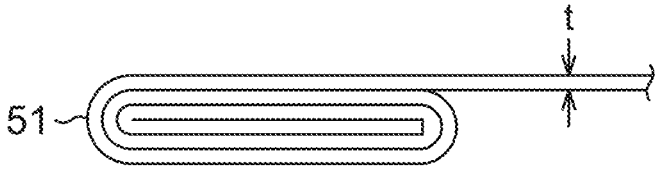
FIG. 2A is a view illustrating an outline of a 2 T bending test.

The total area fraction of the first structure and the eutectoid structure is preferably 55% or more. When the total area fraction is 55% or more, further excellent workability can be obtained. For example, in a 2 T bending test using a plated steel sheet with a thickness of 0.8 mm, cracks do not occur almost at all at a bent top portion. When the total area fraction is 55% or more, the area fraction of the eutectoid structure is 50% to 70% and the area fraction of the first structure is 5% or more, for example. An outline of the 2 T bending test is illustrated in FIG. 2A. As illustrated in FIG. 2A, in the 2 T bending test, a sample of a plated steel sheet with a thickness of t is bent by 180° while providing a space corresponding to 4 t therebetween, and a crack at a bent top portion 51 is observed.

Figure 2B:
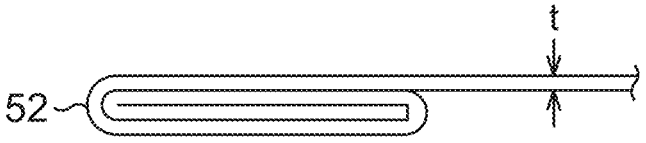
FIG. 2B is a view illustrating an outline of a 1 T bending test.

The total area fraction of the first structure and the eutectoid structure is more preferably 90% or more. When the total area fraction is 90% or more, still further excellent workability can be obtained. For example, in a 1 T bending test using a plated steel sheet with a thickness of 0.8 mm, cracks do not occur almost at all at a bent top portion. When the total area fraction is 90% or more, the area fraction of the eutectoid structure is 50% to 70% and the area fraction of the first structure is 20% or more and less than 30%, for example. An outline of the 1 T bending test is illustrated in FIG. 2B. As illustrated in FIG. 2B, in the 1 T bending test, a sample of a plated steel sheet with a thickness of t is bent by 180° while providing a space corresponding to 2 t therebetween, and a crack at a bent top portion 52 is observed.

Figure 2C:
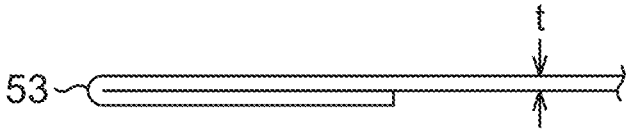
FIG. 2C is a view illustrating an outline of a 0 T bending test.

The total area fraction of the first structure and the eutectoid structure is still more preferably 95% or more. When the total area fraction is 95% or more, extremely excellent workability can be obtained. For example, in a 0 T bending test using a plated steel sheet with a thickness of 0.8 mm, cracks do not occur almost at all at a bent top portion. When the total area fraction is 95% or more, the area fraction of the eutectoid structure is 50% to 65% and the area fraction of the first structure is 30% or more, for example. An outline of the 0 T bending test is illustrated in FIG. 2C. As illustrated in FIG. 2C, in the 0 T bending test, a sample of a plated steel sheet with a thickness of t is bent by 180° while providing no space therebetween, and a crack at a bent top portion 53 is observed.

(Zn Phases, Intermetallic Compound Phases, and the Like)

The Zn phases being structures containing 90% or more of Zn reduce the workability. The plating layer may also contain phases other than the first structure, the eutectoid structure, and the Zn phases, such as Si phases and $Mg_2Si$ phases, for example, and the plating layer may also contain the other intermetallic compound phases ($MgZn_2$ phases and the like), but, these also reduce the workability. Therefore, it is preferable that the plating layer does not contain the Zn phases and the intermetallic compound phases. When an area fraction of the Zn phases is greater than 25%, the workability reduces significantly, and when a total area fraction of the intermetallic compound phases is greater than 9%, the workability reduces significantly. Therefore, the area fraction of the Zn phases is set to 25% or less, and the total area fraction of the intermetallic compound phases is set to 9% or less. The area fraction of the Zn phases is preferably 20% or less also from a viewpoint of corrosion resistance. Further, from a viewpoint of securing higher ductility, the area fraction of the Si phases is preferably 3% or less.

Although it is possible that an intermetallic compound layer of an Al—Mn—Fe-based intermetallic compound containing a slight amount of Si in solid solution or the like, is provided between the plating layer and the steel sheet, when a thickness of the intermetallic compound layer is greater than 2 μm, the workability is likely to reduce. Therefore, the thickness of the intermetallic compound layer is 2000 nm or less, and preferably 1000 nm or less. With the use of the manufacturing method to be described later, the thickness of the intermetallic compound layer becomes 100 nm or more.

Next, a method of manufacturing the plated steel sheet according to the embodiment of the present invention will be described. In this method, a surface of a steel sheet used as a plating original sheet is reduced while performing annealing on the steel sheet, the steel sheet is immersed into a Zn—Al-based plating bath, pulled out of the plating bath and cooled under conditions to be described later.

A material of the steel sheet is not particularly limited. For example, it is possible to use an Al-killed steel, an ultralow carbon steel, a high carbon steel, various high-tensile steels, a steel containing Ni and Cr, and the like. The strength of the steel is also not particularly limited. Conditions at a time of manufacturing the steel sheet in a steelmaking method, a hot-rolling method, a pickling method, a cold-rolling method, and the like are also not particularly limited. A chemical composition of the steel which is, for example, a C content and a Si content, is also not particularly limited. The steel may also contain Ni, Mn, Cr, Mo, Ti or B, or an arbitrary combination thereof. An annealing temperature of the steel sheet is set to about 800° C., for example.

In formation of the plating layer, it is also possible to employ a Sendzimir method or a pre-plating method. When pre-plating of Ni is performed, the intermetallic compound layer sometimes contains Ni.

In the preparation of the Zn—Al-based plating bath, for example, pure Zn, Al, Mg, and an Al—Si alloy are used and mixed so that each component has a predetermined concentration, and are dissolved at 450° C. to 650° C. The steel sheet having a sufficiently-reduced surface is immersed into the plating bath at 450° C. to 600° C., and when this steel sheet is pulled out of the plating bath, a molten metal is adhered to the surface of the steel sheet. By cooling the molten metal, the plating layer is formed. It is preferable that an adhesion amount of the plating layer is adjusted by performing wiping with $N_2$ gas before the molten metal is solidified. In this manufacturing method, a cooling method is differed in accordance with an Al concentration of the plating bath.

(when Al Concentration of Plating Bath is not Less than 20% Nor More than 40%)

When the Al concentration is not less than 20% nor more than 40%, cooling is performed at a first cooling rate of 10° C./second or more from a plating bath temperature to a first temperature within a range of 360° C. to 435° C., cooling is performed at a second cooling rate of 0.02° C./second to 0.50° C./second from the first temperature to a second temperature within a range of 280° C. to 310° C., and thereafter, cooling is performed at a third cooling rate of 30° C./second or more from the second temperature to a room temperature.

By performing the cooling at the first cooling rate of 10° C./second or more to the first temperature corresponding to a solidus temperature in a Zn—Al-based phase diagram, the molten metal is turned into a super-cooled state. For this reason, dendrites (crystals in dendritic form) being macro solidification structures are finely generated, and a number density thereof becomes 1.6 pieces/$cm^2$ or more. When an achievable cooling rate is taken into consideration, the number density of the dendrites is about 25.0 pieces/$cm^2$ at the maximum. In the dendrite, the Al concentration is increased toward a center, and the Zn concentration is increased as a distance from the center increases. As the dendrite becomes finer, a micro solidification segregation inside the dendrite is further alleviated. At the first temperature, a periphery of the dendrite is substantially constituted from Zn phases. Under the condition where the first cooling rate is 10° C./second or more, when the plating bath contains Mg, the $Mg_2Si$ phase being the intermetallic compound crystallized as a primary crystal can be made finer to have an equivalent circle diameter of 2 μm or less. For this reason, it is easy to suppress the reduction in the ductility caused by the formation of the intermetallic compound. When the cooling at the second cooling rate after that is taken into consideration, the first cooling rate is preferably set to 40° C./second or less.

During the cooling from the first temperature to the second temperature, the Al phases containing Zn in solid solution are generated in the dendrite at a portion with relatively high Al concentration, and in the dendrite at a portion with relatively low Al concentration and at a portion containing Zn phases, Al atoms and Zn atoms are mixed, resulting in that the area fraction of the Zn phases is reduced. When the second cooling rate is greater than 0.50° C./second, the Zn atoms and the Al atoms cannot be sufficiently diffused, and a lot of Zn phases are likely to be remained. Therefore, the second cooling rate is set to 0.50° C./second or less. On the other hand, when the second cooling rate is less than 0.02° C./second, the intermetallic compound layer is excessively formed, resulting in that sufficient ductility cannot be obtained. Therefore, the second cooling rate is set to 0.02° C./second or more. Further, a period of time taken for performing the cooling from the first temperature to the second temperature is set to not less than 180 seconds nor more than 1000 seconds. This is for realizing sufficient diffusion of the Zn atoms and the Al atoms, and for suppressing the excessive formation of the intermetallic compound layer.

During the cooling from the second temperature to the room temperature, Zn solid-dissolved in Al is finely precipitated, resulting in that the first structure constituted from the Al phases containing Zn in solid solution and the Zn phases dispersed in the Al phases, and the eutectoid structure constituted from the Al phases and the Zn phases are obtained. Although Zn phases which are independent from the first structure and the eutectoid structure are sometimes precipitated, an area fraction of the Zn phases becomes 20% or less. Within the first structure, the second structure with relatively high Al concentration (Al: 37% to 50%) is generated, and the third structure with relatively low Al concentration (Al: 25% to 36%) is generated between the second structure and the eutectoid structure. As the micro solidification segregation inside the dendrite is further alleviated, the second structure and the third structure are likely to be generated. When the third cooling rate is less than 30° C./second, there is a case where the Zn phases are precipitated, grown, and aggregated, resulting in that the area fraction of the Zn phases in the plating layer becomes 20% or more. Therefore, the third cooling rate is set to 30° C./second or more. The first structure remains as the dendrite, so that a number density of the first structure becomes 1.6 pieces/$cm^2$ to 25.0 pieces/$cm^2$, for example.

(When Al Concentration of Plating Bath is 10% or More and Less than 20%)

When the Al concentration is 10% or more and less than 20%, cooling is performed at a first cooling rate of 10° C./second or more from a plating bath temperature to a first temperature of 410° C., cooling is performed at a second cooling rate of 0.02° C./second to 0.11° C./second from the first temperature to a second temperature of 390° C., and thereafter, cooling is performed at a third cooling rate of 30° C./second or more from the second temperature to a room temperature.

By performing the cooling at the first cooling rate of 10° C./second or more to the first temperature, a molten metal is turned into a super-cooled state. For this reason, dendrites (crystals in dendritic form) being macro solidification structures are finely generated, and a number density thereof becomes 1.6 pieces/$cm^2$ or more. When an achievable cooling rate is taken into consideration, the number density of the dendrites is about 25.0 pieces/$cm^2$ at the maximum. In the dendrite, the Al concentration is increased toward a center, and the Zn concentration is increased as a distance from the center increases. As the dendrite becomes finer, a micro solidification segregation inside the dendrite is further alleviated. At the first temperature, a periphery of the dendrite is substantially constituted from Zn phases. Under the condition where the first cooling rate is 10° C./second or more, when the plating bath contains Mg, the $Mg_2Si$ phase being the intermetallic compound crystallized as a primary crystal can be made finer to have an equivalent circle diameter of 2 μm or less. For this reason, it is easy to suppress the reduction in the ductility caused by the formation of the intermetallic compound. When the cooling at the second cooling rate after that is taken into consideration, the first cooling rate is preferably set to 40° C./second or less.

During the cooling from the first temperature to the second temperature, the Al phases containing Zn in solid solution are generated in the dendrite at a portion with relatively high Al concentration, and in the dendrite at a portion with relatively low Al concentration and at a portion containing Zn phases, Al atoms and Zn atoms are mixed, resulting in that the area fraction of the Zn phases is reduced. When the second cooling rate is greater than 0.11° C./second, the Zn atoms and the Al atoms cannot be sufficiently diffused, and a lot of Zn phases are likely to be remained. Therefore, the second cooling rate is set to 0.11° C./second or less. On the other hand, when the second cooling rate is less than 0.02° C./second, the intermetallic compound layer is excessively formed, resulting in that sufficient ductility cannot be obtained. Therefore, the second cooling rate is set to 0.02° C./second or more. Further, a period of time taken for performing the cooling from the first temperature to the second temperature is set to not less than 180 seconds nor more than 1000 seconds. This is for realizing sufficient diffusion of the Zn atoms and the Al atoms, and for suppressing the excessive formation of the intermetallic compound layer.

During the cooling from the second temperature to the room temperature, Zn solid-dissolved in Al is finely precipitated, resulting in that the first structure constituted from the Al phases containing Zn in solid solution and the Zn phases dispersed in the Al phases, and the eutectoid structure constituted from the Al phases and the Zn phases are obtained. Although Zn phases which are independent from the first structure and the eutectoid structure are sometimes precipitated, an area fraction of the Zn phases becomes 20% or less. Within the first structure, the second structure with relatively high Al concentration (Al: 37% to 50%) is generated, and the third structure with relatively low Al concentration (Al: 25% to 36%) is generated between the second structure and the eutectoid structure. As the micro solidification segregation inside the dendrite is further alleviated, the second structure and the third structure are likely to be generated. When the third cooling rate is less than 30° C./second, there is a case where the Zn phases are precipitated, grown, and aggregated, resulting in that the area fraction of the Zn phases in the plating layer becomes 20% or more. Therefore, the third cooling rate is set to 30° C./second or more. The first structure remains as the dendrite, so that a number density of the first structure becomes 1.6 pieces/$cm^2$ to 25.0 pieces/$cm^2$, for example.

With the use of this method, it is possible to manufacture the plated steel sheet according to the present embodiment, namely, the plated steel sheet including the plating layer containing the first structure and the eutectoid structure at predetermined area fractions. Note that when the second structure is generated, the third structure is inevitably generated, but, it is possible to generate the third structure without generating the second structure.

In this method, the intermetallic compound layer is inevitably formed between the plating layer and the steel sheet. Due to the diffusion of Fe from the steel sheet, a stack of the plating layer and the intermetallic compound layer sometimes contains Fe of about 3%. However, a large amount of Fe is concentrated in the intermetallic compound layer, and an amount of Fe contained in the plating layer is extremely small, so that the characteristic of the plating layer is not substantially affected by Fe.

Next, description will be made on an analysis method of the chemical composition of the plating layer and the intermetallic compound layer and the phases of the plating layer. In the analysis thereof, it is set that, in principle, a sample is obtained from the vicinity of a center in a sheet width direction of the plated steel sheet, and the sample is not obtained from the plated steel sheet within a range of 30 mm from end portions in a rolling direction (longitudinal direction) and within a range of 30 mm from end portions in a direction orthogonal to the rolling direction (sheet width direction), in particular.

In the analysis of the chemical composition of the plating layer and the intermetallic compound layer, the plated steel sheet is immersed into HCl to which an inhibitor is added and having a concentration of 10%, and a peeling solution is analyzed by using an inductively coupled plasma (ICP) method. By this method, it is possible to understand an average chemical composition of the plating layer and the intermetallic compound layer.

The phases which constitute the plating layer are analyzed by an X-ray diffraction method using a Cu target with respect to a surface of the plating layer. In the plating layer in the embodiment of the present invention, peaks of Zn and Al are detected as major peaks. Since an amount of Si is very small, a peak of Si is not detected as a major peak. When Mg is contained, a diffraction peak attributed to $Mg_2Si$ is also detected.

The area fractions of the respective structures contained in the plating layer can be calculated by performing image analysis on a BSE image obtained by SEM and an element mapping image obtained by energy dispersive X-ray spectrometry (EDS).

Next, evaluation methods for the performance of the plating layer will be described. As the performance of the plating layer, there can be cited the corrosion resistance after coating, the plastic deformability, the chipping resistance, the powdering resistance, and the seizing resistance, for example.

In the evaluation of the corrosion resistance after coating, a sample of the plated steel sheet is subjected to zinc phosphate treatment and electrodeposition coating, to thereby prepare a coated plated steel sheet, and a cross-cut which reaches a steel sheet being base iron of the coated plated steel sheet is formed. Subsequently, the coated plated steel sheet having the cross-cut formed thereon is subjected to a combined cyclic corrosion test, and a maximum swelling width around the cross-cut is measured. The combined cyclic corrosion test is performed a plurality of times under the same condition, and an average value of the maximum swelling widths in the tests is calculated. It is possible to evaluate the corrosion resistance after coating based on the average value of the maximum swelling widths. As the plating layer has further excellent corrosion resistance after coating, it has a smaller average value of the maximum swelling widths. Further, a generation of red rust significantly deteriorates an external appearance of the coated plated steel sheet, so that normally, it is evaluated such that the coated plated steel sheet in which a period of time until when the red rust is generated is longer has further excellent corrosion resistance after coating.

In the evaluation of the plastic deformability, a sample of the plated steel sheet is bent by 180° in a sheet width direction in the 0 T bending test, the 1 T bending test, or the 2 T bending test, and the number of cracks at a bent top portion is counted. The plastic deformability can be evaluated based on the number of cracks. The number of cracks is counted by using the SEM. The plated steel sheet having further excellent plastic deformability and better ductility has a smaller number of cracks. It is also possible to evaluate the corrosion resistance of the bent portion by making the sample after being bent by 180° to be directly subjected to an accelerated corrosion test.

In the evaluation of the chipping resistance, a sample of the plated steel sheet is subjected to zinc phosphate treatment and electrodeposition coating, and then subjected to intermediate coating, finish coating, and clear coating, to thereby form a coating film with four-layer structure. Subsequently, crushed stones are made to collide with the coating film which is isothermally held to a predetermined temperature, and a degree of peeling is visually observed. It is possible to evaluate the chipping resistance based on the degree of peeling. It is also possible to classify the degree of peeling through image processing.

In the evaluation of the powdering resistance, a sample of the plated steel sheet is subjected to a 60° bending test in which a sheet width direction is set to a bend axis direction. Subsequently, a width of the plating layer peeled by an adhesive tape (peeling width) is measured at a plurality of points. It is possible to evaluate the powdering resistance based on an average value of the peeling widths.

In the evaluation of the seizing resistance, a sample of the plated steel sheet is subjected to draw bead working to cause sliding among a surface of the sample, a die shoulder portion and a bead portion of a metal mold, and the plating layer adhered to the metal mold is visually observed. It is possible to evaluate the seizing resistance based on the presence/absence of the adhesion of the plating layer and based on the degree of adhesion when the adhesion of the plating layer is occurred.

Note that each of the above-described embodiments merely illustrates concrete examples of implementing the present invention, and the technical scope of the present invention is not to be construed in a restrictive manner by these embodiments. That is, the present invention may be implemented in various forms without departing from the technical spirit or main features thereof.

EXAMPLES

Next, examples of the present invention will be described. A condition in the example is a case of condition adopted to confirm feasibility and an effect of the present invention, and the present invention is not limited to this case of the condition. In the present invention, it is possible to adopt various conditions as long as the object of the present invention is achieved without departing from the gist of the present invention.

Plating baths having chemical compositions represented in Table 1 to Table 4 were prepared. Table 1 to Table 4 also describe melting points and temperatures (plating bath temperatures) of the respective plating baths. A cold-rolled steel sheet having a C concentration of 0.2% and a sheet thickness of 0.8 mm was cut to obtain a plating original sheet having a width of 100 mm and a length of 200 mm. Subsequently, in a furnace in which an oxygen concentration was 20 ppm or less and a temperature was 800° C., a surface of the plating original sheet was reduced by using a mixed gas of 95 volume % of $N_2$ and 5 volume % of $H_2$, the plating original sheet was air-cooled by an $N_2$ gas, and when a temperature of the plating original sheet reached the plating bath temperature+20° C., the plating original sheet was immersed into the plating bath for about three seconds. After the plating original sheet was immersed into the plating bath, while adjusting a plating adhesion amount using an $N_2$ wiping gas, the plating original sheet having a molten metal adhered thereto was pulled out at a rate of 100 mm/second. A sheet temperature was monitored by using a thermocouple spot-welded to a center portion of the plating original sheet.

After the plating original sheet was pulled out of the plating bath, the plating layer was cooled to a room temperature under conditions represented in Table 1 to Table 4. Specifically, gas cooling was performed at a first cooling rate from the plating bath temperature to a first temperature, cooling was performed at a second cooling rate from the first temperature to a second temperature, and thereafter, cooling was performed at a third cooling rate from the second temperature to the room temperature. In a manner as described above, various plated steel sheets were obtained. An underline in Table 1 to Table 4 indicates that the underlined item is out of a desirable range.

TABLE 1

| TEST No. | PLATING BATH CHEMICAL COMPOSITION (MASS %) Zn | Al | Si | Mg | MELTING POINT (° C.) | BATH TEMPERATURE (° C.) | COOLING CONDITION FIRST COOLING RATE (° C./SECOND) | FIRST TEMPERATURE (° C.) | SECOND TEMPERATURE (° C.) | SECOND COOLING RATE (° C./SECOND) | COOLING TIME AT SECOND COOLING RATE (SECOND) | THIRD COOLING RATE (° C./SECOND) | REMARKS |
|---|---|---|---|---|---|---|---|---|---|---|---|---|---|
| 1 | 91.8 | 8 | 0.2 | 0 | 410 | 440 | 10 | 410 | 390 | 0.03 | 600 | 1000 | FOR COMPARATIVE EXAMPLE |
| 2 | 89.8 | 10 | 0.2 | 0 | 425 | 455 | 15 | 410 | 390 | 0.03 | 600 | 1000 | FOR INVENTION EXAMPLE |
| 3 | 89.95 | 10 | 0.05 | 0 | 427 | 457 | 10 | 410 | 390 | 0.03 | 600 | 1000 | |
| 4 | 90 | 10 | 0.00 | 0 | 429 | 459 | 10 | 410 | 390 | 0.03 | 600 | 1000 | FOR COMPARATIVE EXAMPLE |
| 5 | 87.8 | 12 | 0.2 | 0 | 430 | 460 | 10 | 410 | 390 | 0.03 | 600 | 1000 | FOR INVENTION EXAMPLE |
| 6 | 85.75 | 14 | 0.2 | 0.05 | 440 | 470 | 10 | 410 | 390 | 0.03 | 600 | 1000 | |
| 7 | 82.8 | 14 | 0.2 | 3 | 440 | 470 | 10 | 410 | 390 | 0.03 | 600 | 1000 | FOR COMPARATIVE EXAMPLE |
| 8 | 85.8 | 14 | 0.2 | 0 | 440 | 470 | 10 | 410 | 390 | 0.03 | 600 | 1000 | FOR INVENTION EXAMPLE |
| 9 | 83.8 | 16 | 0.2 | 0 | 450 | 480 | 30 | 410 | 390 | 0.03 | 600 | 1000 | |
| 10 | 81.8 | 18 | 0.2 | 0 | 460 | 490 | 10 | 410 | 390 | 0.03 | 600 | 1000 | |
| 11 | 81.99 | 18 | 0.01 | 0 | 460 | 490 | 10 | 410 | 390 | 0.03 | 600 | 1000 | FOR COMPARATIVE EXAMPLE |
| 12 | 81.8 | 18 | 0.2 | 0 | 460 | 490 | 10 | 410 | 390 | 0.03 | 600 | 10 | |
| 13 | 81.4 | 18 | 0.2 | 0.4 | 465 | 490 | 20 | 410 | 390 | 0.03 | 600 | 1000 | FOR INVENTION EXAMPLE |
| 14 | 79.8 | 20 | 0.2 | 0 | 475 | 505 | 10 | 360 | 290 | 0.12 | 600 | 1000 | |
| 15 | 77.8 | 22 | 0.2 | 0 | 480 | 510 | 10 | 365 | 280 | 0.09 | 950 | 1000 | |
| 16 | 77.8 | 22 | 0.2 | 0 | 480 | 510 | 10 | 365 | 280 | 0.14 | 600 | 1000 | |
| 17 | 77.8 | 22 | 0.2 | 0 | 480 | 510 | 10 | 365 | 300 | 0.33 | 200 | 1000 | |
| 18 | 77.8 | 22 | 0.2 | 0 | 480 | 511 | 10 | 366 | 280 | 0.14 | 600 | 40 | |
| 19 | 77.8 | 22 | 0.2 | 0 | 480 | 510 | 10 | 365 | 280 | 0.85 | 100 | 1000 | FOR COMPARATIVE EXAMPLE |
| 20 | 77.8 | 22 | 0.2 | 0 | 480 | 510 | COOLED TO ROOM TEMPERATURE AT 10° C./SECOND | | | | | | |
| 21 | 75.8 | 24 | 0.2 | 0 | 485 | 515 | 10 | 370 | 280 | 0.15 | 600 | 1000 | FOR INVENTION EXAMPLE |
| 22 | 73.8 | 26 | 0.2 | 0 | 490 | 520 | 10 | 375 | 295 | 0.13 | 600 | 1000 | |
| 23 | 73.8 | 26 | 0.2 | 0 | 495 | 525 | 10 | 380 | 280 | 0.09 | 1100 | 1000 | FOR COMPARATIVE EXAMPLE |
| 24 | 71.8 | 27 | 0.2 | 1 | 500 | 530 | 10 | 385 | 280 | 0.18 | 600 | 1000 | |
| 25 | 71.8 | 28 | 0.2 | 0 | 505 | 535 | 10 | 390 | 290 | 0.17 | 600 | 1000 | FOR INVENTION EXAMPLE |

TABLE 2

| TEST No. | PLATING BATH CHEMICAL COMPOSITION (MASS %) Zn | Al | Si | Mg | MELTING POINT (° C.) | BATH TEMPERATURE (° C.) | COOLING CONDITION FIRST COOLING RATE (° C./SECOND) | FIRST TEMPERATURE (° C.) | SECOND TEMPERATURE (° C.) | SECOND COOLING RATE (° C./SECOND) | COOLING TIME AT SECOND COOLING RATE (SECOND) | THIRD COOLING RATE (° C./SECOND) | REMARKS |
|---|---|---|---|---|---|---|---|---|---|---|---|---|---|
| 26 | 69.8 | 30 | 0.2 | 0 | 510 | 540 | 10 | 395 | 280 | 0.19 | 600 | 1000 | FOR |
| 27 | 67.8 | 32 | 0.2 | 0 | 520 | 550 | 10 | 405 | 310 | 0.16 | 600 | 1000 | INVENTION |
| 28 | 65.8 | 34 | 0.2 | 0 | 525 | 555 | 10 | 410 | 280 | 0.22 | 600 | 1000 | EXAMPLE |
| 29 | 63.8 | 36 | 0.2 | 0 | 530 | 560 | 10 | 415 | 280 | 0.23 | 600 | 1000 | |
| 30 | 61.8 | 38 | 0.2 | 0 | 535 | 565 | 10 | 420 | 280 | 0.23 | 600 | 1000 | |
| 31 | 59.8 | 40 | 0.2 | 0 | 540 | 570 | 10 | 425 | 280 | 0.24 | 600 | 1000 | |
| 32 | 57.8 | 42 | 0.2 | 0 | 550 | 580 | 10 | 435 | 280 | 0.26 | 600 | 1000 | FOR COMPARATIVE EXAMPLE |
| 33 | 89.5 | 10 | 0.5 | 0 | 420 | 450 | 10 | 410 | 390 | 0.03 | 600 | 1000 | FOR |
| 34 | 87.5 | 12 | 0.5 | 0 | 430 | 460 | 10 | 410 | 390 | 0.03 | 600 | 1000 | INVENTION |
| 35 | 85.5 | 14 | 0.5 | 0 | 440 | 470 | 10 | 410 | 390 | 0.03 | 600 | 1000 | EXAMPLE |
| 36 | 84.5 | 14 | 0.5 | 1 | 440 | 470 | 10 | 410 | 390 | 0.03 | 600 | 1000 | |
| 37 | 83.5 | 16 | 0.5 | 0 | 450 | 480 | 10 | 410 | 390 | 0.03 | 600 | 1000 | |
| 38 | 81.5 | 18 | 0.5 | 0 | 460 | 490 | 10 | 410 | 390 | 0.03 | 600 | 1000 | FOR |
| 39 | 79.5 | 20 | 0.5 | 0 | 475 | 505 | 10 | 360 | 280 | 0.13 | 600 | 1000 | INVENTION EXAMPLE |
| 40 | 80 | 20 | 0.00 | 0 | 460 | 490 | 10 | 345 | 280 | 0.11 | 600 | 1000 | FOR COMPARATIVE EXAMPLE |
| 41 | 77.5 | 22 | 0.5 | 0 | 480 | 510 | 10 | 365 | 280 | 0.14 | 600 | 1000 | FOR |
| 42 | 77.5 | 22 | 0.5 | 0 | 480 | 510 | 10 | 365 | 280 | 0.17 | 500 | 60 | INVENTION EXAMPLE |
| 43 | 77.5 | 22 | 0.5 | 0 | 480 | 510 | 10 | 365 | 280 | 0.57 | 150 | 40 | FOR |
| 44 | 97.5 | 2 | 0.5 | 0 | 480 | 510 | | COOLEDTOROOMTEMPERATUREAT10°C./SECOND | | | | | COMPARATIVE |
| 45 | 76 | 22 | 0.5 | 1.5 | 480 | 510 | 10 | 365 | 280 | 0.14 | 600 | 1000 | EXAMPLE |
| 46 | 75.5 | 24 | 0.5 | 0 | 485 | 515 | 10 | 370 | 300 | 0.12 | 600 | 1000 | FOR |
| 47 | 73.5 | 26 | 0.5 | 0 | 490 | 520 | 10 | 375 | 280 | 0.16 | 600 | 1000 | INVENTION EXAMPLE |
| 48 | 71.5 | 26 | 0.5 | 2 | 491 | 521 | 10 | 376 | 280 | 0.16 | 600 | 1000 | FOR COMPARATIVE EXAMPLE |
| 49 | 71.5 | 28 | 0.5 | 0 | 505 | 535 | 10 | 390 | 280 | 0.18 | 600 | 1000 | FOR INVENTION EXAMPLE |

TABLE 3

| TEST | PLATING BATH CHEMICAL COMPOSITION (MASS %) | | | | MELTING POINT | BATH TEMPERATURE | COOLING CONDITION FIRST COOLING RATE | FIRST TEMPERATURE | SECOND TEMPERATURE | SECOND COOLING RATE | COOLING TIME AT SECOND COOLING RATE | THIRD COOLING RATE | |
|---|---|---|---|---|---|---|---|---|---|---|---|---|---|
| No. | Zn | Al | Si | Mg | (° C.) | (° C.) | (° C./SECOND) | (° C.) | (° C.) | (° C./SECOND) | (SECOND) | (° C./SECOND) | REMARKS |
| 50 | 70.5 | 29 | 0.5 | 0 | 505 | 535 | 10 | 390 | 280 | 0.10 | 1100 | 1000 | FOR COMPARATIVE EXAMPLE |
| 51 | 69.5 | 30 | 0.5 | 0 | 510 | 540 | 10 | 395 | 280 | 0.19 | 600 | 1000 | FOR INVENTION EXAMPLE |
| 52 | 68.5 | 30 | 0.5 | 1 | 510 | 540 | 10 | 395 | 310 | 0.14 | 600 | 1000 | |
| 53 | 67.5 | 32 | 0.5 | 0 | 520 | 550 | 10 | 405 | 290 | 0.19 | 600 | 1000 | |
| 54 | 65.5 | 34 | 0.5 | 0 | 525 | 555 | 10 | 410 | 280 | 0.22 | 600 | 1000 | |
| 55 | 63.5 | 36 | 0.5 | 0 | 530 | 560 | 10 | 415 | 300 | 0.19 | 600 | 1000 | |
| 56 | 61.5 | 38 | 0.5 | 0 | 535 | 565 | 10 | 420 | 280 | 0.23 | 600 | 1000 | |
| 57 | 59.5 | 40 | 0.5 | 0 | 540 | 570 | 10 | 425 | 280 | 0.24 | 600 | 1000 | |
| 58 | 92 | 7 | 1 | 0 | 401 | 431 | 10 | 410 | 390 | 0.03 | 600 | 1000 | FOR COMPARATIVE EXAMPLE |
| 59 | 89 | 10 | 1 | 0 | 475 | 505 | 10 | 410 | 390 | 0.03 | 600 | 1000 | FOR INVENTION EXAMPLE |
| 60 | 86 | 14 | 0.00 | 0 | 460 | 490 | 10 | 410 | 390 | 0.03 | 600 | 1000 | FOR COMPARATIVE EXAMPLE |
| 61 | 84 | 15 | 1 | 0 | 475 | 505 | 10 | 410 | 390 | 0.03 | 600 | 1000 | FOR INVENTION EXAMPLE |
| 62 | 79 | 20 | 1 | 0 | 477 | 507 | 10 | 362 | 280 | 0.14 | 600 | 1000 | |
| 63 | 77 | 22 | 1 | 0 | 487 | 517 | 15 | 372 | 280 | 0.10 | 950 | 1000 | |
| 64 | 77 | 22 | 1 | 0 | 487 | 517 | 10 | 372 | 280 | 0.15 | 600 | 1000 | |
| 65 | 77 | 22 | 1 | 0 | 487 | 517 | 10 | 372 | 280 | 0.46 | 200 | 1000 | |
| 66 | 77 | 22 | 1 | 0 | 487 | 517 | 10 | 372 | 280 | 0.61 | 150 | 1000 | |
| 67 | 77 | 22 | 1 | 0 | 487 | 517 | COOLED TO ROOM TEMPERATURE AT 10° C./SECOND | | | | | | FOR COMPARATIVE EXAMPLE |
| 68 | 75 | 22 | 1 | 2 | 481 | 511 | 10 | 366 | 280 | 0.14 | 600 | 1000 | FOR INVENTION EXAMPLE |
| 69 | 72.4 | 24 | 1 | 2.6 | 481 | 511 | 10 | 366 | 280 | 0.14 | 600 | 1000 | FOR COMPARATIVE EXAMPLE |
| 70 | 74 | 25 | 1 | 0 | 483 | 513 | 10 | 368 | 280 | 0.15 | 600 | 1000 | FOR INVENTION EXAMPLE |
| 71 | 69 | 30 | 1 | 0 | 510 | 540 | 10 | 395 | 280 | 0.19 | 600 | 1000 | |
| 72 | 64 | 35 | 1 | 0 | 528 | 558 | 10 | 413 | 280 | 0.22 | 600 | 1000 | |
| 73 | 83 | 15 | 2 | 0 | 475 | 505 | 10 | 410 | 390 | 0.03 | 600 | 1000 | |
| 74 | 78 | 20 | 2 | 0 | 480 | 510 | 10 | 405 | 280 | 0.21 | 600 | 1000 | |

TABLE 4

| | PLATING BATH | | | | | | COOLING CONDITION | | | | | | |
|---|---|---|---|---|---|---|---|---|---|---|---|---|---|
| | CHEMICAL COMPOSITION (MASS %) | | | | MELTING | BATH TEMPERATURE | FIRST COOLING RATE | FIRST TEMPERATURE | SECOND TEMPERATURE | SECOND COOLING RATE | COOLING TIME AT SECOND COOLING RATE | THIRD COOLING RATE | |
| TEST No. | Zn | Al | Si | Mg | POINT (° C.) | (° C.) | (° C./SECOND) | (° C.) | (° C.) | (° C./SECOND) | (SECOND) | (° C./SECOND) | REMARKS |
| 75 | 73 | 22 | 2 | 3 | 480 | 510 | 10 | 425 | 280 | 0.24 | 600 | 1000 | FOR INVENTION EXAMPLE |
| 76 | 76 | 22 | 2 | 0 | 480 | 510 | 10 | 425 | 280 | 0.24 | 600 | 1000 | |
| 77 | 76 | 22 | 2 | 0 | 480 | 510 | COOLEDTOROOMTEMPERATUREAT10°C./SECOND | | | | | | FOR COMPARATIVE EXAMPLE |
| 78 | 72 | 22 | 2 | 4 | 480 | 510 | 10 | 425 | 280 | 0.24 | 600 | 1000 | FOR INVENTION EXAMPLE |
| 79 | 73 | 25 | 2 | 0 | 483 | 513 | 10 | 425 | 280 | 0.24 | 600 | 1000 | |
| 80 | 68 | 30 | 2 | 0 | 510 | 540 | 10 | 415 | 290 | 0.21 | 600 | 1000 | |
| 81 | 63 | 35 | 2 | 0 | 528 | 558 | 10 | 420 | 280 | 0.23 | 600 | 1000 | |
| 82 | 70.5 | 22 | 2.5 | 5 | 480 | 510 | 10 | 430 | 280 | 0.50 | 300 | 1000 | |
| 83 | 75.5 | 22 | 2.5 | 0 | 480 | 510 | 10 | 430 | 280 | 0.25 | 600 | 1000 | |
| 84 | 72.5 | 25 | 2.5 | 0 | 483 | 513 | 10 | 435 | 310 | 0.21 | 600 | 1000 | |
| 85 | 57.5 | 40 | 2.5 | 0 | 540 | 570 | 10 | 440 | 280 | 0.27 | 600 | 1000 | |
| 86 | 55.5 | 42 | 2.5 | 0 | 550 | 580 | 10 | 435 | 280 | 0.26 | 600 | 1000 | FOR COMPARATIVE EXAMPLE |
| 87 | 74 | 22 | 4 | 0 | 480 | 510 | 10 | 430 | 290 | 0.23 | 600 | 1000 | FOR INVENTION EXAMPLE |
| 88 | 71 | 25 | 4 | 0 | 483 | 513 | 10 | 435 | 280 | 0.26 | 600 | 1000 | |
| 89 | 66 | 25 | 4 | 5 | 483 | 513 | 10 | 435 | 280 | 0.39 | 400 | 1000 | |
| 90 | 65 | 25 | 4 | 6 | 483 | 513 | 10 | 435 | 280 | 0.39 | 400 | 1000 | FOR COMPARATIVE EXAMPLE |
| 91 | 56 | 40 | 4 | 0 | 540 | 570 | 10 | 440 | 300 | 0.23 | 600 | 1000 | FOR INVENTION EXAMPLE |
| 92 | 54 | 42 | 4 | 0 | 550 | 580 | 10 | 435 | 280 | 0.26 | 600 | 1000 | FOR COMPARATIVE EXAMPLE |
| 93 | 55.5 | 40 | 4.5 | 0 | 570 | 600 | 10 | 455 | 280 | 0.29 | 600 | 1000 | |
| 94 | COMMERCIALLY AVAILABLE Zn PLATED STEEL SHEET | | | | | | | | | | | | |
| 95 | ALLOYED Zn PLATED STEEL SHEET | | | | | | | | | | | | |
| 96 | Zn ELECTROPLATED STEEL SHEET | | | | | | | | | | | | |
| 97 | 77.4 | 22 | 0.6 | 0 | 480 | 510 | 15 | 430 | 280 | 3.5 | 43 | 45 | |
| 98 | 75.5 | 23 | 1.5 | 0 | 485 | 515 | 15 | 430 | 280 | 1.5 | 100 | 45 | |
| 99 | 65.1 | 34 | 0.9 | 0 | 525 | 555 | 15 | 430 | 280 | 7.5 | 20 | 35 | |

Next, each of the plated steel sheets was immersed into HCl to which an inhibitor was added and having a concentration of 10%, and a peeling solution was analyzed by the ICP method, to thereby specify an average chemical composition of the plating layer and the intermetallic compound layer. Further, each of the plated steel sheets was cut to produce five test pieces each having a width of 15 mm and a length of 25 mm, each of the test pieces was embedded in a resin, and polishing was performed. Thereafter, regarding each of the test pieces, there were obtained a SEM image of a cross section of the plating layer and an element mapping image obtained by the EDS. Subsequently, based on the element mapping image obtained by the EDS, area fractions of the second structure, the third structure, the eutectoid structure, the Zn phases, the intermetallic compound layer, the $Mg_2Si$ phases, the Si phases, and the other metallic compound in a stack of the plating layer and the intermetallic compound layer were measured. Concretely, photographing of one visual field was performed with respect to one sample, namely, photographing of five visual fields in total was performed with respect to one plated steel sheet, and the area fractions were measured by image analysis. Each visual field was set to include a region with a size of 50 μm×200 μm of the plating layer. Further, based on this measurement result, the area fractions of the second structure, the third structure, the eutectoid structure, the Zn phases, the $Mg_2Si$ phases, the Si phases, and the other metallic compound in the plating layer were calculated. Besides, based on the element mapping image obtained by the EDS, a thickness of the intermetallic compound layer existed between the plating layer and the steel sheet was measured. Results thereof are shown in Table 5 to Table 8.

In identification of the second structure, the third structure, and the eutectoid structure, regarding a structure capable of being recognized as any of the second structure, the third structure, and the eutectoid structure based on the element mapping image obtained by the EDS, an average Al concentration was specified through EDS analysis, and a structure with the average Al concentration of 37% to 50% was judged as the second structure, a structure with the average Al concentration of 25% to 36% was judged as the third structure, and a structure with the average Al concentration of 10% to 24% was judged as the eutectoid structure. A structure whose average crystal grain diameter was 1 μm or less in terms of equivalent circle radius and constituted from two phases of Al phases and Zn phases was recognized as any of the second structure, the third structure, and the eutectoid structure.

An optical microscope image was used to count the number of the first structure existed within a visual field of 30 mm×30 mm, to thereby calculate a number density of the first structure. A result thereof is also shown in Table 5 to Table 8. An underline in Table 5 to Table 8 indicates that the underlined numeric value is out of the range of the present invention.

TABLE 5

| TEST | AVERAGE CHEMICAL COMPOSITION OF PLATING LAYER AND INTERMETALLIC COMPOUND LAYER (MASS %) | | | | PLATING LAYER AREA FRACTION (%) | | | | | |
|---|---|---|---|---|---|---|---|---|---|---|
| | | | | | FIRST STRUCTURE | | | | FIRST STRUCTURE + | |
| No. | Zn | Al | Si | Mg | SECOND STRUCTURE | THIRD STRUCTURE | SUM | EUTECTOID STRUCTURE | EUTECTOID STRUCTURE | Zn PHASE |
| 1 | 91.8 | 8 | 0.2 | 0 | 0 | 0 | 0 | 40 | 40 | 60 |
| 2 | 89.8 | 10 | 0.2 | 0 | 3 | 2 | 5 | 71 | 76 | 24 |
| 3 | 90 | 10 | 0.05 | 0 | 4 | 2 | 6 | 73 | 79 | 21 |
| 4 | 90 | 10 | 0.00 | 0 | 13 | 7 | 20 | 67 | 87 | 13 |
| 5 | 87.8 | 12 | 0.2 | 0 | 3 | 2 | 5 | 73 | 78 | 22 |
| 6 | 85.8 | 14 | 0.2 | 0.05 | 3 | 3 | 6 | 72 | 79 | 19 |
| 7 | 82.8 | 14 | 0.2 | 3 | 5 | 2 | 7 | 63 | 70 | 19 |
| 8 | 85.8 | 14 | 0.2 | 0 | 3 | 3 | 6 | 74 | 81 | 19 |
| 9 | 83.8 | 16 | 0.2 | 0 | 13 | 8 | 21 | 70 | 92 | 8 |
| 10 | 81.8 | 18 | 0.2 | 0 | 13 | 9 | 22 | 69 | 92 | 8 |
| 11 | 82 | 18 | 0.01 | 0 | 3 | 3 | 6 | 34 | 40 | 60 |
| 12 | 81.8 | 18 | 0.2 | 0 | 0 | 0 | 0 | 44 | 44 | 56 |
| 13 | 81.4 | 18 | 0.2 | 0.4 | 15 | 10 | 26 | 67 | 93 | 3 |
| 14 | 79.8 | 20 | 0.2 | 0 | 17 | 15 | 33 | 65 | 98 | 2 |
| 15 | 77.8 | 22 | 0.2 | 0 | 23 | 17 | 40 | 57 | 97 | 3 |
| 16 | 77.8 | 22 | 0.2 | 0 | 17 | 15 | 33 | 65 | 98 | 2 |
| 17 | 77.8 | 22 | 0.2 | 0 | 16 | 11 | 27 | 66 | 93 | 7 |
| 18 | 77.8 | 22 | 0.2 | 0 | 18 | 15 | 34 | 64 | 98 | 2 |
| 19 | 77.8 | 22 | 0.2 | 0 | 1 | 2 | 3 | 74 | 78 | 22 |
| 20 | 77.8 | 22 | 0.2 | 0 | 0 | 0 | 0 | 65 | 65 | 35 |
| 21 | 75.8 | 24 | 0.2 | 0 | 17 | 14 | 31 | 65 | 96 | 4 |
| 22 | 73.8 | 26 | 0.2 | 0 | 18 | 15 | 34 | 63 | 97 | 3 |
| 23 | 73.8 | 26 | 0.2 | 0 | 11 | 7 | 18 | 75 | 93 | 7 |
| 24 | 71.8 | 27 | 0.2 | 1 | 15 | 10 | 25 | 52 | 77 | 2 |
| 25 | 71.8 | 28 | 0.2 | 0 | 19 | 15 | 35 | 65 | 100 | 0 |

TABLE 5-continued

| | PLATING LAYER | | | | | |
|---|---|---|---|---|---|---|
| | AREA FRACTION (%) | | | | | |
| | INTERMETALLIC COMPOUND PHASE | | | | NUMBER | AVERAGE Al CONCEN- |
| TEST No. | $Mg_2Si$ PHASE | OTHER INTERMETALLIC COMPOUND PHASE | SUM | Si PHASE | DENSITY OF FIRST STRUCTURE (PIECE/$cm^2$) | TRATION OF SECOND STRUCTURE (MASS %) |
| 1 | 0 | 0 | 0 | 0 | 0 | — |
| 2 | 0 | 0 | 0 | 0 | 2.5 | 41 |
| 3 | 0 | 0 | 0 | 0 | 2 | 37 |
| 4 | 0 | 0 | 0 | 0 | 1.8 | 37 |
| 5 | 0 | 0 | 0 | 0 | 2 | 41 |
| 6 | 2 | 0 | 2 | 0 | 2 | 42 |
| 7 | 2 | 8 | 10 | 0 | 2 | 42 |
| 8 | 0 | 0 | 0 | 0 | 2 | 42 |
| 9 | 0 | 0 | 0 | 0 | 2 | 42 |
| 10 | 0 | 0 | 0 | 0 | 2 | 41 |
| 11 | 0 | 0 | 0 | 0 | 2 | 37 |
| 12 | 0 | 0 | 0 | 0 | 0 | — |
| 13 | 4 | 0 | 4 | 0 | 2.8 | 39 |
| 14 | 0 | 0 | 0 | 0 | 2 | 46 |
| 15 | 0 | 0 | 0 | 0 | 2 | 45 |
| 16 | 0 | 0 | 0 | 0 | 2.5 | 48 |
| 17 | 0 | 0 | 0 | 0 | 2.4 | 43 |
| 18 | 0 | 0 | 0 | 0 | 2 | 47 |
| 19 | 0 | 0 | 0 | 0 | 2 | 43 |
| 20 | 0 | 0 | 0 | 0 | 0 | — |
| 21 | 0 | 0 | 0 | 0 | 2 | 46 |
| 22 | 0 | 0 | 0 | 0 | 2 | 50 |
| 23 | 0 | 0 | 0 | 0 | 2.2 | 50 |
| 24 | 4 | 17 | 21 | 0 | 2.4 | 41 |
| 25 | 0 | 0 | 0 | 0 | 2.6 | 43 |

| | PLATING LAYER | | | THICKNESS | |
|---|---|---|---|---|---|
| TEST No. | AVERAGE Al CONCEN-TRATION OF THIRD STRUCTURE (MASS %) | AVERAGE Al CONCEN-TRATION OF EUTECTOID STRUCTURE (MASS %) | EQUIVALENT CIRCLE DIAMETER OF $Mg_2Si$ (μm) | OF INTER-METALLIC COMPOUND LAYER (μm) | REMARKS |
| 1 | — | 18 | 0 | 0.3 | COMPARATIVE EXAMPLE |
| 2 | 26 | 19 | 0 | 0.3 | INVENTION |
| 3 | 25 | 19 | 0 | 0.3 | EXAMPLE |
| 4 | 25 | 18 | 0 | 25.5 | COMPARATIVE EXAMPLE |
| 5 | 25 | 16 | 0 | 0.3 | INVENTION |
| 6 | 26 | 17 | 0.2 | 0.6 | EXAMPLE |
| 7 | 26 | 17 | 0.2 | 0.6 | COMPARATIVE EXAMPLE |
| 8 | 26 | 17 | 0 | 0.6 | INVENTION |
| 9 | 28 | 18 | 0 | 0.6 | EXAMPLE |
| 10 | 28 | 19 | 0 | 0.6 | |
| 11 | 25 | 18 | 0 | 19.5 | COMPARATIVE |
| 12 | — | 21 | 0 | 0.3 | EXAMPLE |
| 13 | 25 | 18 | 0.4 | 0.9 | INVENTION |
| 14 | 25 | 23 | 0 | 0.6 | EXAMPLE |
| 15 | 25 | 23 | 0 | 0.3 | |
| 16 | 26 | 22 | 0 | 0.6 | |
| 17 | 25 | 19 | 0 | 0.3 | |
| 18 | 26 | 22 | 0 | 0.6 | |
| 19 | 28 | 20 | 0 | 0.6 | COMPARATIVE |
| 20 | — | 22 | 0 | 0.3 | EXAMPLE |
| 21 | 29 | 19 | 0 | 0.3 | INVENTION |
| 22 | 27 | 17 | 0 | 0.6 | EXAMPLE |
| 23 | 26 | 16 | 0 | 12.9 | COMPARATIVE |
| 24 | 28 | 23 | 0.4 | 0.3 | EXAMPLE |
| 25 | 27 | 22 | 0 | 0.6 | INVENTION EXAMPLE |

TABLE 6

| TEST No. | AVERAGE CHEMICAL COMPOSITION OF PLATING LAYER AND INTER-METALLIC COMPOUND LAYER (MASS %) Zn | Al | Si | Mg | PLATING LAYER AREA FRACTION (%) FIRST STRUCTURE SECOND STRUCTURE | THIRD STRUCTURE | SUM | EUTECTOID STRUCTURE | FIRST STRUCTURE + EUTECTOID STRUCTURE | Zn PHASE |
|---|---|---|---|---|---|---|---|---|---|---|
| 26 | 69.8 | 30 | 0.2 | 0 | 19 | 15 | 34 | 66 | 100 | 0 |
| 27 | 67.8 | 32 | 0.2 | 0 | 16 | 11 | 28 | 66 | 94 | 6 |
| 28 | 65.8 | 34 | 0.2 | 0 | 17 | 11 | 29 | 66 | 95 | 5 |
| 29 | 63.8 | 36 | 0.2 | 0 | 15 | 11 | 26 | 66 | 92 | 8 |
| 30 | 61.8 | 38 | 0.2 | 0 | 16 | 12 | 28 | 67 | 95 | 5 |
| 31 | 59.8 | 40 | 0.2 | 0 | 14 | 11 | 26 | 66 | 92 | 8 |
| 32 | 57.8 | 42 | 0.2 | 0 | 2 | 4 | 7 | 84 | 91 | 9 |
| 33 | 89.5 | 10 | 0.5 | 0 | 3 | 2 | 5 | 73 | 78 | 22 |
| 34 | 87.5 | 12 | 0.5 | 0 | 4 | 3 | 7 | 74 | 81 | 19 |
| 35 | 85.5 | 14 | 0.5 | 0 | 5 | 2 | 7 | 72 | 80 | 20 |
| 36 | 84.5 | 14 | 0.5 | 1 | 5 | 2 | 7 | 72 | 80 | 20 |
| 37 | 83.5 | 16 | 0.5 | 0 | 14 | 8 | 23 | 70 | 93 | 7 |
| 38 | 81.5 | 18 | 0.5 | 0 | 15 | 9 | 24 | 67 | 92 | 8 |
| 39 | 79.5 | 20 | 0.5 | 0 | 18 | 15 | 34 | 65 | 99 | 1 |
| 40 | 80 | 20 | 0.00 | 0 | 7 | 7 | 14 | 86 | 100 | 0 |
| 41 | 77.5 | 22 | 0.5 | 0 | 18 | 17 | 35 | 63 | 98 | 2 |
| 42 | 77.5 | 22 | 0.5 | 0 | 19 | 15 | 34 | 64 | 98 | 2 |
| 43 | 77.5 | 22 | 0.5 | 0 | 2 | 1 | 3 | 73 | 77 | 23 |
| 44 | 97.5 | 2 | 0.5 | 0 | 0 | 0 | 0 | 66 | 66 | 34 |
| 45 | 76 | 22 | 0.5 | 1.5 | 15 | 10 | 25 | 52 | 77 | 2 |
| 46 | 75.5 | 24 | 0.5 | 0 | 20 | 12 | 33 | 64 | 97 | 3 |
| 47 | 73.5 | 26 | 0.5 | 0 | 19 | 14 | 33 | 63 | 96 | 4 |
| 48 | 71.5 | 26 | 0.5 | 2 | 15 | 10 | 25 | 52 | 77 | 2 |
| 49 | 71.5 | 28 | 0.5 | 0 | 19 | 14 | 33 | 65 | 98 | 2 |

| TEST No. | PLATING LAYER AREA FRACTION (%) INTERMETALLIC COMPOUND PHASE $Mg_2Si$ PHASE | OTHER INTERMETALLIC COMPOUND PHASE | SUM | Si PHASE | NUMBER DENSITY OF FIRST STRUCTURE (PIECE/$cm^2$) | AVERAGE Al CONCEN-TRATION OF SECOND STRUCTURE (MASS %) |
|---|---|---|---|---|---|---|
| 26 | 0 | 0 | 0 | 0 | 2.2 | 49 |
| 27 | 0 | 0 | 0 | 0 | 2.1 | 47 |
| 28 | 0 | 0 | 0 | 0 | 2 | 45 |
| 29 | 0 | 0 | 0 | 0 | 2 | 48 |
| 30 | 0 | 0 | 0 | 0 | 2.8 | 49 |
| 31 | 0 | 0 | 0 | 0 | 3.5 | 50 |
| 32 | 0 | 0 | 0 | 0 | 2 | 49 |
| 33 | 0 | 0 | 0 | 0 | 2 | 38 |
| 34 | 0 | 0 | 0 | 0 | 2.4 | 41 |
| 35 | 0 | 0 | 0 | 0 | 2 | 40 |
| 36 | 0 | 0 | 0 | 0 | 2.7 | 40 |
| 37 | 0 | 0 | 0 | 0 | 2.5 | 40 |
| 38 | 0 | 0 | 0 | 0 | 2 | 41 |
| 39 | 0 | 0 | 0 | 0 | 2 | 44 |
| 40 | 0 | 0 | 0 | 0 | 2.9 | 46 |
| 41 | 0 | 0 | 0 | 0 | 1.8 | 48 |
| 42 | 0 | 0 | 0 | 0 | 2 | 47 |
| 43 | 0 | 0 | 0 | 0 | 2 | 48 |
| 44 | 0 | 0 | 0 | 0 | 0 | — |
| 45 | 4 | 17 | 21 | 0 | 2.9 | 41 |
| 46 | 0 | 0 | 0 | 0 | 2.4 | 45 |
| 47 | 0 | 0 | 0 | 0 | 2 | 49 |
| 48 | 4 | 17 | 21 | 0 | 2.3 | 41 |
| 49 | 0 | 0 | 0 | 0 | 2.6 | 46 |

TABLE 6-continued

| TEST No. | PLATING LAYER: AVERAGE Al CONCENTRATION OF THIRD STRUCTURE (MASS %) | AVERAGE Al CONCENTRATION OF EUTECTOID STRUCTURE (MASS %) | EQUIVALENT CIRCLE DIAMETER OF $Mg_2Si$ (μm) | THICKNESS OF INTERMETALLIC COMPOUND LAYER (μm) | REMARKS |
|---|---|---|---|---|---|
| 26 | 34 | 22 | 0 | 0.9 | INVENTION |
| 27 | 32 | 18 | 0 | 0.6 | EXAMPLE |
| 28 | 29 | 19 | 0 | 0.6 | |
| 29 | 27 | 23 | 0 | 0.3 | |
| 30 | 27 | 20 | 0 | 0.3 | |
| 31 | 33 | 15 | 0 | 0.6 | |
| 32 | 25 | 19 | 0 | 16.5 | COMPARATIVE EXAMPLE |
| 33 | 25 | 16 | 0 | 0.3 | INVENTION |
| 34 | 26 | 18 | 0 | 0.3 | EXAMPLE |
| 35 | 32 | 15 | 0 | 0.6 | |
| 36 | 32 | 15 | 0 | 0.6 | |
| 37 | 27 | 21 | 0 | 0.9 | |
| 38 | 29 | 20 | 0 | 0.6 | INVENTION |
| 39 | 26 | 16 | 0 | 0.6 | EXAMPLE |
| 40 | 26 | 19 | 0 | 25.8 | COMPARATIVE EXAMPLE |
| 41 | 27 | 23 | 0 | 0.3 | INVENTION |
| 42 | 28 | 22 | 0 | 0.3 | EXAMPLE |
| 43 | 28 | 23 | 0 | 0.6 | COMPARATIVE |
| 44 | — | 22 | 0 | 0.3 | EXAMPLE |
| 45 | 28 | 23 | 0.4 | 0.3 | |
| 46 | 35 | 20 | 0 | 0.6 | INVENTION |
| 47 | 34 | 18 | 0 | 0.3 | EXAMPLE |
| 48 | 28 | 23 | 0.4 | 0.3 | COMPARATIVE EXAMPLE |
| 49 | 31 | 20 | 0 | 0.3 | INVENTION EXAMPLE |

TABLE 7

| TEST | AVERAGE CHEMICAL COMPOSITION OF PLATING LAYER AND INTERMETALLIC COMPOUND LAYER (MASS %) | | | | PLATING LAYER AREA FRACTION (%): FIRST STRUCTURE | | | | | | INTERMETALLIC COMPOUND PHASE | | | |
|---|---|---|---|---|---|---|---|---|---|---|---|---|---|---|
| | | | | | SECOND STRUCTURE | THIRD STRUCTURE | SUM | EUTECTOID STRUCTURE | FIRST STRUCTURE + EUTECTOID STRUCTURE | Zn PHASE | $Mg_2Si$ PHASE | OTHER INTERMETALLIC COMPOUND PHASE | SUM | Si PHASE |
| No. | Zn | Al | Si | Mg | | | | | | | | | | |
| 50 | 70.5 | 29 | 0.5 | 0 | 13 | 5 | 18 | 75 | 93 | 7 | 0 | 0 | 0 | 0 |
| 51 | 69.5 | 30 | 0.5 | 0 | 19 | 16 | 36 | 62 | 98 | 2 | 0 | 0 | 0 | 0 |
| 52 | 68.5 | 30 | 0.5 | 1 | 15 | 13 | 29 | 62 | 91 | 2 | 7 | 0 | 7 | 0 |
| 53 | 67.5 | 32 | 0.5 | 0 | 11 | 11 | 22 | 69 | 92 | 8 | 0 | 0 | 0 | 0 |
| 54 | 65.5 | 34 | 0.5 | 0 | 13 | 10 | 23 | 69 | 92 | 8 | 0 | 0 | 0 | 0 |
| 55 | 63.5 | 36 | 0.5 | 0 | 16 | 11 | 27 | 66 | 93 | 7 | 0 | 0 | 0 | 0 |
| 56 | 61.5 | 38 | 0.5 | 0 | 15 | 10 | 25 | 67 | 92 | 8 | 0 | 0 | 0 | 0 |
| 57 | 59.5 | 40 | 0.5 | 0 | 15 | 12 | 28 | 65 | 93 | 7 | 0 | 0 | 0 | 0 |
| 58 | 92 | 7 | 1 | 0 | 0 | 0 | 0 | 75 | 75 | 25 | 0 | 0 | 0 | 0 |
| 59 | 89 | 10 | 1 | 0 | 6 | 5 | 11 | 69 | 81 | 19 | 0 | 0 | 0 | 0 |
| 60 | 86 | 14 | 0.00 | 0 | 11 | 6 | 17 | 61 | 78 | 22 | 0 | 0 | 0 | 0 |
| 61 | 84 | 15 | 1 | 0 | 10 | 9 | 19 | 70 | 90 | 10 | 0 | 0 | 0 | 0 |
| 62 | 79 | 20 | 1 | 0 | 17 | 14 | 31 | 65 | 96 | 4 | 0 | 0 | 0 | 0 |
| 63 | 77 | 22 | 1 | 0 | 24 | 18 | 42 | 57 | 99 | 1 | 0 | 0 | 0 | 0 |
| 64 | 77 | 22 | 1 | 0 | 19 | 15 | 35 | 63 | 98 | 2 | 0 | 0 | 0 | 0 |
| 65 | 77 | 22 | 1 | 0 | 14 | 10 | 24 | 67 | 92 | 8 | 0 | 0 | 0 | 0 |
| 66 | 77 | 22 | 1 | 0 | 1 | 2 | 3 | 76 | 79 | 21 | 0 | 0 | 0 | 0 |
| 67 | 77 | 22 | 1 | 0 | 0 | 0 | 0 | 65 | 65 | 35 | 0 | 0 | 0 | 0 |
| 68 | 75 | 22 | 1 | 2 | 17 | 14 | 31 | 62 | 93 | 2 | 5 | 0 | 5 | 0 |
| 69 | 72.4 | 4 | 1 | 2.6 | 4 | 5 | 9 | 68 | 76 | 3 | 6 | 15 | 21 | 0 |
| 70 | 74 | 25 | 1 | 0 | 19 | 15 | 35 | 63 | 98 | 2 | 0 | 0 | 0 | 0 |

TABLE 7-continued

| | | | | | | | | | | | | | | |
|---|---|---|---|---|---|---|---|---|---|---|---|---|---|---|
| 71 | 69 | 30 | 1 | 0 | 19 | 13 | 32 | 66 | 98 | 2 | 0 | 0 | 0 | 0 |
| 72 | 64 | 35 | 1 | 0 | 17 | 10 | 28 | 65 | 93 | 7 | 0 | 0 | 0 | 0 |
| 73 | 83 | 15 | 2 | 0 | 5 | 2 | 7 | 77 | 84 | 16 | 0 | 0 | 0 | 0 |
| 74 | 78 | 20 | 2 | 0 | 20 | 14 | 34 | 64 | 98 | 2 | 0 | 0 | 0 | 0 |

| | PLATING LAYER | | | | | | |
|---|---|---|---|---|---|---|---|
| TEST No. | NUMBER DENSITY OF FIRST STRUCTURE (PIECE/cm$^2$) | AVERAGE Al CONCENTRATION OF SECOND STRUCTURE (MASS %) | AVERAGE Al CONCENTRATION OF THIRD STRUCTURE (MASS %) | AVERAGE Al CONCENTRATION OF EUTECTOID STRUCTURE (MASS %) | EQUIVALENT CIRCLE DIAMETER OF $Mg_2Si$ (μm) | THICKNESS OF INTERMETALLIC COMPOUND LAYER (μm) | REMARKS |
| 50 | 2.7 | 50 | 26 | 16 | 0 | 13.5 | COMPARATIVE EXAMPLE |
| 51 | 2.1 | 47 | 33 | 16 | 0 | 0.6 | INVENTION EXAMPLE |
| 52 | 2.6 | 47 | 33 | 16 | 0.5 | 0.6 | |
| 53 | 2.8 | 48 | 35 | 19 | 0 | 0.6 | |
| 54 | 2.4 | 50 | 36 | 20 | 0 | 0.3 | |
| 55 | 2.3 | 49 | 25 | 22 | 0 | 0.3 | |
| 56 | 2.8 | 49 | 26 | 20 | 0 | 0.3 | |
| 57 | 2.7 | 50 | 29 | 19 | 0 | 0.6 | |
| 58 | 0 | — | — | 22 | 0 | 7.2 | COMPARATIVE EXAMPLE |
| 59 | 2.1 | 41 | 25 | 18 | 0 | 0.6 | INVENTION EXAMPLE |
| 60 | 2.5 | 39 | 28 | 16 | 0 | 24.6 | COMPARATIVE EXAMPLE |
| 61 | 2.8 | 41 | 25 | 18 | 0 | 0.6 | INVENTION EXAMPLE |
| 62 | 2.9 | 44 | 26 | 21 | 0 | 0.3 | |
| 63 | 3.4 | 46 | 27 | 18 | 0 | 0.3 | |
| 64 | 1.9 | 48 | 31 | 18 | 0 | 0.6 | |
| 65 | 1.7 | 49 | 33 | 17 | 0 | 0.6 | |
| 66 | 2 | 50 | 25 | 18 | 0 | 0.6 | COMPARATIVE EXAMPLE |
| 67 | 0 | — | — | 21 | 0 | 0.3 | |
| 68 | 2.4 | 48 | 32 | 19 | 0.5 | 0.3 | INVENTION EXAMPLE |
| 69 | 2.6 | 49 | 25 | 23 | 0.6 | 0.3 | COMPARATIVE EXAMPLE |
| 70 | 1.9 | 46 | 34 | 22 | 0 | 0.6 | INVENTION EXAMPLE |
| 71 | 1.7 | 45 | 25 | 21 | 0 | 0.9 | |
| 72 | 2 | 49 | 26 | 19 | 0 | 0.6 | |
| 73 | 2.8 | 41 | 29 | 18 | 0 | 0.3 | |
| 74 | 2.9 | 46 | 27 | 16 | 0 | 0.9 | |

TABLE 8

| TEST | AVERAGE CHEMICAL COMPOSITION OF PLATING LAYER AND INTERMETALLIC COMPOUND LAYER (MASS %) | | | | PLATING LAYER AREA FRACTION (%) | | | | | | | | | |
|---|---|---|---|---|---|---|---|---|---|---|---|---|---|---|
| | | | | | FIRST STRUCTURE | | | | FIRST STRUCTURE + EUTECTOID STRUCTURE | INTERMETALLIC COMPOUND PHASE | | | | |
| | | | | | | | | | | | | OTHER INTERMETALLIC COMPOUND PHASE | | |
| No. | Zn | Al | Si | Mg | SECOND STRUCTURE | THIRD STRUCTURE | SUM | EUTECTOID STRUCTURE | | Zn PHASE | $Mg_2Si$ PHASE | | SUM | Si PHASE |
| 75 | 73 | 22 | 2 | 3 | 19 | 14 | 33 | 63 | 96 | 1 | 3 | 0 | 3 | 0 |
| 76 | 76 | 22 | 2 | 0 | 18 | 14 | 33 | 64 | 97 | 3 | 0 | 0 | 0 | 0 |
| 77 | 76 | 22 | 2 | 0 | 0 | 0 | 0 | 66 | 66 | 34 | 0 | 0 | 0 | 0 |
| 78 | 72 | 22 | 2 | 4 | 18 | 14 | 32 | 62 | 94 | 1 | 5 | 0 | 5 | 0 |
| 79 | 73 | 25 | 2 | 0 | 19 | 14 | 34 | 64 | 98 | 2 | 0 | 0 | 0 | 0 |
| 80 | 68 | 30 | 2 | 0 | 20 | 13 | 34 | 63 | 97 | 3 | 0 | 0 | 0 | 0 |
| 81 | 63 | 35 | 2 | 0 | 18 | 10 | 29 | 64 | 93 | 7 | 0 | 0 | 0 | 0 |
| 82 | 70.5 | 22 | 2.5 | 5 | 16 | 10 | 27 | 65 | 92 | 2 | 6 | 0 | 6 | 0 |
| 83 | 75.5 | 22 | 2.5 | 0 | 20 | 12 | 32 | 66 | 98 | 2 | 0 | 0 | 0 | 0 |
| 84 | 72.5 | 25 | 2.5 | 0 | 20 | 14 | 35 | 62 | 97 | 3 | 0 | 0 | 0 | 0 |
| 85 | 57.5 | 40 | 2.5 | 0 | 19 | 12 | 31 | 64 | 95 | 5 | 0 | 0 | 0 | 0 |
| 86 | 55.5 | 42 | 2.5 | 0 | 4 | 2 | 7 | 85 | 91 | 9 | 0 | 0 | 0 | 0 |
| 87 | 74 | 22 | 4 | 0 | 21 | 10 | 32 | 65 | 97 | 3 | 0 | 0 | 0 | 0 |
| 88 | 71 | 25 | 4 | 0 | 20 | 15 | 36 | 62 | 98 | 2 | 0 | 0 | 0 | 0 |
| 89 | 66 | 25 | 4 | 5 | 17 | 12 | 30 | 62 | 92 | 2 | 6 | 0 | 6 | 0 |

TABLE 8-continued

| | | | | | | | | | | | | | | |
|---|---|---|---|---|---|---|---|---|---|---|---|---|---|---|
| 90 | 65 | 25 | 4 | 6 | 10 | 8 | 18 | 62 | 81 | 2 | 3 | 14 | 17 | 0 |
| 91 | 56 | 40 | 4 | 0 | 14 | 9 | 23 | 68 | 92 | 8 | 0 | 0 | 0 | 0 |
| 92 | 54 | 42 | 4 | 0 | 4 | 4 | 9 | 82 | 91 | 9 | 0 | 0 | 0 | 0 |
| 93 | 55.5 | 40 | 4.5 | 0 | 4 | 2 | 6 | 65 | 71 | 3 | 0 | 0 | 0 | 26 |
| 94 | COMMERCIALLY AVAILABLE Zn PLATED STEEL SHEET | | | | | | | | | | | | | |
| 95 | ALLOYED Zn PLATED STEEL SHEET | | | | | | | | | | | | | |
| 96 | Zn ELECTROPLATED STEEL SHEET | | | | | | | | | | | | | |
| 97 | 77.4 | 22 | 0.6 | 0 | 0 | 0 | 0 | 99 | 99 | 1 | 0 | 0 | 0 | 0 |
| 98 | 75.5 | 23 | 1.5 | 0 | 0 | 0 | 0 | 98 | 98 | 2 | 0 | 0 | 0 | 0 |
| 99 | 65.1 | 34 | 0.9 | 0 | 0 | 0 | 0 | 98 | 98 | 2 | 0 | 0 | 0 | 0 |

| | PLATING LAYER | | | | | | |
|---|---|---|---|---|---|---|---|
| TEST No. | NUMBER DENSITY OF FIRST STRUCTURE (PIECE/cm$^2$) | AVERAGE Al CONCEN-TRATION OF SECOND STRUCTURE (MASS %) | AVERAGE Al CONCENTRATION OF THIRD STRUCTURE (MASS %) | AVERAGE Al CONCENTRATION OF EUTECTOID STRUCTURE (MASS %) | EQUIVALENT CIRCLE DIAMETER OF $Mg_2Si$ (μm) | THICKNESS OF INTERMETALLIC COMPOUND LAYER (μm) | REMARKS |
| 75 | 2.4 | 48 | 27 | 20 | 0 | 0.3 | INVENTION |
| 76 | 2.8 | 49 | 26 | 18 | 0 | 0.6 | EXAMPLE |
| 77 | 0 | — | — | 23 | 0 | 0.3 | COMPARATIVE EXAMPLE |
| 78 | 2 | 50 | 25 | 16 | 0.5 | 0.3 | INVENTION |
| 79 | 2 | 49 | 33 | 17 | 0 | 0.6 | EXAMPLE |
| 80 | 2 | 48 | 31 | 22 | 0 | 0.6 | |
| 81 | 2.8 | 46 | 29 | 21 | 0 | 0.6 | |
| 82 | 2.6 | 47 | 29 | 22 | 0.7 | 0.9 | |
| 83 | 2.1 | 47 | 29 | 22 | 0 | 0.9 | |
| 84 | 2 | 49 | 31 | 23 | 0 | 0.6 | |
| 85 | 2.3 | 47 | 28 | 17 | 0 | 0.9 | |
| 86 | 1.9 | 49 | 22 | 19 | 0 | 16.2 | COMPARATIVE EXAMPLE |
| 87 | 2.5 | 47 | 29 | 22 | 0 | 0.6 | INVENTION |
| 88 | 2 | 49 | 31 | 23 | 0 | 0.6 | EXAMPLE |
| 89 | 2 | 49 | 31 | 23 | 0.7 | 0.6 | |
| 90 | 2.7 | 49 | 31 | 23 | 0.3 | 0.6 | COMPARATIVE EXAMPLE |
| 91 | 2.9 | 47 | 28 | 17 | 0 | 0.6 | INVENTION EXAMPLE |
| 92 | 2.1 | 49 | 29 | 19 | 0 | 16.5 | COMPARATIVE |
| 93 | 2.1 | 50 | 30 | 20 | 0 | 0.3 | EXAMPLE |
| 94 | COMMERCIALLY AVAILABLE Zn PLATED STEEL SHEET | | | | | | |
| 95 | ALLOYED Zn PLATED STEEL SHEET | | | | | | |
| 96 | Zn ELECTROPLATED STEEL SHEET | | | | | | |
| 97 | 0 | — | — | 20 | 0 | 0.3 | |
| 98 | 0 | — | — | 24 | 0 | 0.1 | |
| 99 | 0 | — | — | 23 | 0 | 0.2 | |

After that, evaluations of the powdering resistance, the chipping resistance, the seizing resistance, the plastic deformability, and the corrosion resistance after coating were performed regarding the respective plated steel sheets.

In the evaluation of the powdering resistance of the plating layer, each of the plated steel sheets was cut to produce a test piece having a width of 40 mm, a length of 100 mm, and a thickness of 0.8 mm, and with respect to each test piece, a 60° bending test was performed by using a V bending tester in which a sheet width direction was set to a bend axis direction and a radius of curvature was set to 5 mmR. Next, a width of the plating layer peeled by an adhesive tape (peeling width) was measured at five points, and an average value of the widths (average peeling width) was calculated. When the average peeling width was 0.1 mm or less, it was evaluated as "A", when the average peeling width was greater than 0.1 mm and 1.0 mm or less, it was evaluated as "B", when the average peeling width was greater than 1.0 mm and 2.0 mm or less, it was evaluated as "C", and when the average peeling width was greater than 2.0 mm, it was evaluated as "D".

In the evaluation of the seizing resistance of the plating layer, each of the plated steel sheets was cut to produce two test pieces each having a width of 80 mm and a length of 350 mm, and with respect to each test piece, draw bead working was performed by using a fixture imitating a die and a bead, and sliding of 150 mm or more in length was caused among a surface of the test piece, a die shoulder portion, and a bead portion. A radius of curvature of the die shoulder portion and a radius of curvature of the bead portion of the aforementioned fixture were set to 2 mmR and 5 mmR, respectively, a pressing pressure of the die was set to 60 kN/m$^2$, and a pull-out rate in the draw bead working was set to 2 m/min. When performing the draw bead working, a lubricating oil (550F: manufactured by Nippon Parkerizing Co., Ltd.) was coated on surfaces of the test piece by 0.5 g/m$^2$ per both surfaces. Subsequently, the plating layer adhered to the fixture was visually observed, in which when the plating layer was not adhered, it was evaluated as "A", when the plating layer was adhered in a powder form, it was evaluated as "B", when the plating layer was adhered in a strip form, it was evaluated as "C", and when the plating layer was totally peeled and adhered, it was evaluated as "D".

In the evaluation of the plastic deformability of the plating layer, each of the plated steel sheets was cut to produce a test piece having a width of 30 mm, a length of 60 mm, and a thickness of 0.8 mm, and with respect to each test piece, the 0 T bending test, the 1 T bending test, and the 2 T bending test were performed. Next, by using the SEM, a region where a width and a length of a bent top portion of the plating layer were 1.6 mm and 30 mm, respectively, was observed, and the number of cracks at the bent top portion was counted. With respect to each of the plated steel sheets, three or more of the test pieces were prepared for each of the 0 T bending test, the 1 T bending test, and the 2 T bending test, and an average value of the number of cracks was calculated. With respect to each of the 0 T bending test, the 1 T bending test, and the 2 T bending test, when the average crack number was 0, it was evaluated as "A", when the average crack number was 1 to 20, it was evaluated as "B", when the average crack number was 21 to 100, it was evaluated as "C", and when the average crack number was greater than 100, it was evaluated as "D".

In the evaluation of the corrosion resistance after coating of the plating layer, each of the plated steel sheets was cut to produce a sample having a width of 50 mm and a length of 100 mm, and zinc phosphate treatment using a zinc phosphate-based conversion treatment solution (SURFDINE SD5350 system: manufactured by Nipponpaint Industrial Coatings Co., LTD.) was performed on each sample. Next, electrodeposition coating using a coating material (POWERNIX 110F system: manufactured by Nippon Parkerizing Co., Ltd.) was performed to form a coating film of 20 am, and baking was carried out at a temperature of 150° C. for 20 minutes. After that, on each sample, cross-cuts reaching the steel sheet were formed, a combined cyclic corrosion test according to JASO M609-91 was performed to measure maximum swelling widths at eight places around the cross-cuts after completion of each of cycles of 60, 90, 120, and 150, and an average value of the maximum swelling widths was determined. As the cross-cuts, two cross-cuts each having a length $40\times\sqrt{2}$ mm were formed. When the swelling width from the cross-cuts was 1 mm or less, it was evaluated as "A", when the swelling width from the cross-cuts was greater than 1 mm and 2 mm less, it was evaluated as "B", when the swelling width from the cross-cuts was greater than 2 mm, it was evaluated as "C", and when a red rust was generated regardless of the swelling width, it was evaluated as "D".

Regarding the chipping resistance of the plating layer, zinc phosphate treatment and electrodeposition coating similar to those performed when evaluating the corrosion resistance after coating were performed on the plating layer, and then intermediate coating, finish coating, and clear coating were performed to produce a coating film so that a film thickness became 40 μm as a whole. Next, a gravel test instrument (manufactured by Suga Test Instruments Co., Ltd.) was used to make 100 g of No. 7 crushed stones collide with the coating film cooled to −20° C. at an angle of 90 degrees, from a position distant by 30 cm at an air pressure of 3.0 kg/cm$^2$, and a degree of peeling was visually observed. When the peeling did not occur at all, it was evaluated as "A", when a peeling area was small and a peeling frequency was low, it was evaluated as "B", when the peeling area was large and the peeling frequency was low, it was evaluated as "C", and when the peeling area was large and the peeling frequency was high, it was evaluated as "D".

The evaluation results of the powdering resistance, the chipping resistance, the seizing resistance, the plastic deformability, and the corrosion resistance after coating are shown in Table 9 to Table 12.

TABLE 9

| PERFORMANCE EVALUATION RESULT | | | | | | | | | | | |
|---|---|---|---|---|---|---|---|---|---|---|---|
| | | | | BENDING TEST | | | CORROSION RESISTANCE AFTER COATING | | | | |
| TEST No. | POWDERING RESISTANCE | CHIPPING RESISTANCE | SEIZING RESISTANCE | 2 T | 1 T | 0 T | 60 CYCLES | 90 CYCLES | 120 CYCLES | 150 CYCLES | REMARKS |
| 1 | B | B | D | C | C | D | C | D | D | D | COMPARATIVE EXAMPLE |
| 2 | A | A | B | A | B | B | A | B | B | C | INVENTION |
| 3 | A | A | B | A | B | B | A | B | B | C | EXAMPLE |
| 4 | D | D | B | D | D | D | C | D | D | D | COMPARATIVE EXAMPLE |
| 5 | A | A | B | A | B | B | A | B | B | C | INVENTION |
| 6 | A | A | B | B | B | B | A | A | B | B | EXAMPLE |
| 7 | A | D | B | D | D | D | A | A | B | B | COMPARATIVE EXAMPLE |
| 8 | A | A | B | A | B | B | A | B | B | B | INVENTION |
| 9 | A | A | B | A | A | B | A | A | B | B | EXAMPLE |
| 10 | A | A | B | A | A | B | A | A | B | B | |
| 11 | D | D | A | D | D | D | C | D | D | D | COMPARATIVE |
| 12 | C | C | B | C | C | D | D | D | D | D | EXAMPLE |
| 13 | A | A | B | A | A | B | A | A | A | A | INVENTION |
| 14 | A | A | A | A | A | A | A | A | A | A | EXAMPLE |
| 15 | A | A | A | A | A | A | A | A | A | A | |
| 16 | A | A | A | A | A | A | A | A | A | A | |
| 17 | A | A | A | A | A | B | A | A | B | B | |
| 18 | A | A | A | A | A | A | A | A | A | A | |
| 19 | B | C | A | B | C | C | C | C | B | B | COMPARATIVE |
| 20 | B | C | A | D | D | D | C | D | D | D | EXAMPLE |
| 21 | A | A | A | A | A | A | A | A | A | A | INVENTION |
| 22 | A | A | A | A | A | A | A | A | A | A | EXAMPLE |
| 23 | D | D | A | D | D | D | C | D | D | D | COMPARATIVE |
| 24 | D | D | A | D | D | D | A | A | B | B | EXAMPLE |
| 25 | A | A | A | A | A | A | A | A | A | A | INVENTION EXAMPLE |

TABLE 10

| | PERFORMANCE EVALUATION RESULT | | | | | | | | | | |
|---|---|---|---|---|---|---|---|---|---|---|---|
| | | | | BENDING TEST | | | CORROSION RESISTANCE AFTER COATING | | | | |
| TEST No. | POWDERING RESISTANCE | CHIPPING RESISTANCE | SEIZING RESISTANCE | 2 T | 1 T | 0 T | 60 CYCLES | 90 CYCLES | 120 CYCLES | 150 CYCLES | REMARKS |
| 26 | A | A | A | A | A | A | A | A | A | A | INVENTION |
| 27 | A | A | A | A | A | B | A | A | B | B | EXAMPLE |
| 28 | A | A | A | A | A | B | A | A | B | B | |
| 29 | A | A | A | A | A | B | A | A | B | B | |
| 30 | A | A | A | A | A | B | A | A | B | B | |
| 31 | A | A | A | A | A | B | A | A | B | B | |
| 32 | D | D | A | D | D | D | B | C | C | C | COMPARATIVE EXAMPLE |
| 33 | A | A | B | A | B | B | A | B | B | C | INVENTION |
| 34 | A | A | B | A | B | B | A | B | B | B | EXAMPLE |
| 35 | A | A | B | A | B | B | A | B | B | B | |
| 36 | A | A | B | A | B | B | A | A | B | B | |
| 37 | A | A | B | A | A | B | A | A | B | B | |
| 38 | A | A | B | A | A | B | A | A | B | B | INVENTION |
| 39 | A | A | A | A | A | A | A | A | A | A | EXAMPLE |
| 40 | B | D | B | D | D | D | B | C | C | C | COMPARATIVE EXAMPLE |
| 41 | A | A | A | A | A | A | A | A | A | A | INVENTION |
| 42 | A | A | A | A | A | A | A | A | A | A | EXAMPLE |
| 43 | B | C | A | B | C | C | C | C | C | C | COMPARATIVE |
| 44 | B | C | C | C | D | D | C | D | D | D | EXAMPLE |
| 45 | B | D | A | D | D | D | A | A | A | A | |
| 46 | A | A | A | A | A | A | A | A | A | A | INVENTION |
| 47 | A | A | A | A | A | A | A | A | A | A | EXAMPLE |
| 48 | B | D | A | D | D | D | A | A | A | A | COMPARATIVE EXAMPLE |
| 49 | A | A | A | A | A | A | A | A | A | A | INVENTION EXAMPLE |

TABLE 11

| | PERFORMANCE EVALUATION RESULT | | | | | | | | | | |
|---|---|---|---|---|---|---|---|---|---|---|---|
| | | | | BENDING TEST | | | CORROSION RESISTANCE AFTER COATING | | | | |
| TEST No. | POWDERING RESISTANCE | CHIPPING RESISTANCE | SEIZING RESISTANCE | 2 T | 1 T | 0 T | 60 CYCLES | 90 CYCLES | 120 CYCLES | 150 CYCLES | REMARKS |
| 50 | D | D | A | D | D | D | C | D | D | D | COMPARATIVE EXAMPLE |
| 51 | A | A | A | A | A | A | A | A | A | A | INVENTION |
| 52 | A | A | A | A | A | B | A | A | A | A | EXAMPLE |
| 53 | A | A | A | A | A | B | A | A | B | B | |
| 54 | A | A | A | A | A | B | A | A | B | B | |
| 55 | A | A | A | A | A | B | A | A | B | B | |
| 56 | A | A | A | A | A | B | A | A | B | B | |
| 57 | A | A | A | A | A | B | A | A | B | B | |
| 58 | B | B | D | B | C | C | C | D | D | D | COMPARATIVE EXAMPLE |
| 59 | A | A | B | A | B | B | A | B | B | B | INVENTION EXAMPLE |
| 60 | D | D | A | D | D | D | C | D | D | D | COMPARATIVE EXAMPLE |
| 61 | A | A | B | A | B | B | A | B | B | B | INVENTION |
| 62 | A | A | A | A | A | A | A | A | A | A | EXAMPLE |
| 63 | A | A | A | A | A | A | A | A | A | A | |
| 64 | A | A | A | A | A | A | A | A | A | A | |
| 65 | A | A | B | A | A | B | A | A | B | B | |
| 66 | B | C | A | C | C | C | C | C | C | C | COMPARATIVE |
| 67 | B | C | C | C | D | D | C | D | D | D | EXAMPLE |
| 68 | A | A | A | A | A | B | A | A | A | A | INVENTION EXAMPLE |
| 69 | B | D | A | D | D | D | A | A | A | A | COMPARATIVE EXAMPLE |
| 70 | A | A | A | A | A | A | A | A | A | A | INVENTION |

TABLE 11-continued

| | PERFORMANCE EVALUATION RESULT | | | | | | | | | | |
|---|---|---|---|---|---|---|---|---|---|---|---|
| | | | | BENDING TEST | | | CORROSION RESISTANCE AFTER COATING | | | | |
| TEST No. | POWDERING RESISTANCE | CHIPPING RESISTANCE | SEIZING RESISTANCE | 2 T | 1 T | 0 T | 60 CYCLES | 90 CYCLES | 120 CYCLES | 150 CYCLES | REMARKS |
| 71 | A | A | A | A | A | A | A | A | A | A | EXAMPLE |
| 72 | A | A | B | A | A | B | A | A | B | B | |
| 73 | A | A | B | A | B | B | A | B | B | B | |
| 74 | A | A | A | A | A | A | A | A | A | A | |

TABLE 12

| | PERFORMANCE EVALUATION RESULT | | | | | | | | | | |
|---|---|---|---|---|---|---|---|---|---|---|---|
| | | | | BENDING TEST | | | CORROSION RESISTANCE AFTER COATING | | | | |
| TEST No. | POWDERING RESISTANCE | CHIPPING RESISTANCE | SEIZING RESISTANCE | 2 T | 1 T | 0 T | 60 CYCLES | 90 CYCLES | 120 CYCLES | 150 CYCLES | REMARKS |
| 75 | A | A | A | A | A | B | A | A | A | A | INVENTION |
| 76 | A | A | A | A | A | A | A | A | A | A | EXAMPLE |
| 77 | B | C | C | C | D | D | C | D | D | D | COMPARATIVE EXAMPLE |
| 78 | A | A | A | A | A | B | A | A | A | A | INVENTION |
| 79 | A | A | A | A | A | A | A | A | A | A | EXAMPLE |
| 80 | A | A | A | A | A | A | A | A | A | A | |
| 81 | A | A | B | A | A | B | A | A | B | B | |
| 82 | A | A | A | A | A | B | A | A | A | A | |
| 83 | A | A | A | A | A | A | A | A | A | A | |
| 84 | A | A | A | A | A | A | A | A | A | A | |
| 85 | A | A | B | A | A | B | A | A | B | B | |
| 86 | D | D | A | D | D | D | B | C | C | C | COMPARATIVE EXAMPLE |
| 87 | A | A | A | A | A | A | A | A | A | A | INVENTION |
| 88 | A | A | A | A | A | A | A | A | A | A | EXAMPLE |
| 89 | A | A | A | A | B | B | A | A | A | A | |
| 90 | D | D | A | C | D | D | A | B | C | C | COMPARATIVE EXAMPLE |
| 91 | A | A | B | A | B | B | A | A | B | B | INVENTION EXAMPLE |
| 92 | D | D | A | D | D | D | B | C | C | C | COMPARATIVE |
| 93 | B | D | C | D | D | D | B | B | B | B | EXAMPLE |
| 94 | B | B | D | B | C | C | C | C | D | D | |
| 95 | D | D | A | D | D | D | D | D | D | D | |
| 96 | B | C | D | B | B | C | C | C | D | D | |
| 97 | C | C | A | B | C | C | B | B | C | D | |
| 98 | C | C | A | B | C | C | B | B | C | D | |
| 99 | C | C | A | B | C | C | B | B | C | D | |

As shown in Table 1, Table 5, and Table 9, in test No. 1, the Al concentration of the plating bath was insufficient, so that the area fraction of the first structure was insufficient, and the area fraction of the Zn phases was excessive, resulting in that it was not possible to sufficiently obtain the seizing resistance, the plastic deformability, and the corrosion resistance after coating.

In test No. 4, the Si concentration of the plating bath was insufficient, so that the intermetallic compound layer was grown right after the steel sheet was immersed into the plating bath, and the intermetallic compound layer was formed thickly, resulting in that it was not possible to sufficiently obtain the powdering resistance, the chipping resistance, the plastic deformability, and the corrosion resistance after coating.

In test No. 7, the Mg concentration of the plating bath was excessive relative to the Si concentration, so that the $MgZn_2$ phases being the intermetallic compound phases were excessively contained in the plating layer, resulting in that it was not possible to sufficiently obtain the chipping resistance and the plastic deformability.

In test No. 11, the Si concentration of the plating bath was insufficient, so that the intermetallic compound layer was grown right after the steel sheet was immersed into the plating bath, and the intermetallic compound layer was formed thickly, resulting in that it was not possible to sufficiently obtain the powdering resistance, the chipping resistance, the plastic deformability, and the corrosion resistance after coating.

In test No. 12, the third cooling rate was insufficient, so that the area fraction of the first structure was insufficient, and the area fraction of the Zn phases was excessive, resulting in that it was not possible to sufficiently obtain the powdering resistance, the chipping resistance, the plastic deformability, and the corrosion resistance after coating.

In test No. 19, the second cooling rate was excessive, so that the area fraction of the first structure was insufficient, and a lot of cracks occurred in the 1 T bending test and the 0 T bending test, resulting in that it was not possible to sufficiently obtain the plastic deformability. Further, it was also not possible to sufficiently obtain the chipping resistance and the corrosion resistance after coating.

In test No. 20, the cooling after the plating treatment was performed to the room temperature at the cooling rate of 10° C./second, so that the area fraction of the first structure was insufficient, and the area fraction of the Zn phases was excessive, resulting in that it was not possible to sufficiently obtain the chipping resistance, the plastic deformability, and the corrosion resistance after coating.

In test No. 23, the period of time taken for performing the cooling at the second cooling rate was too long, so that the intermetallic compound layer was formed thickly, resulting in that it was not possible to sufficiently obtain the corrosion resistance after coating the plastic deformability, the powdering resistance, and the chipping resistance.

In test No. 24, the Mg concentration of the plating bath was excessive relative to the Si concentration, so that the $MgZn_2$ phases being the intermetallic compound phases were excessively contained in the plating layer, resulting in that it was not possible to sufficiently obtain the powdering resistance, the chipping resistance, and the plastic deformability.

As shown in Table 2, Table 6, and Table 10, in test No. 32, the Al concentration of the plating bath was excessive, so that the intermetallic compound layer was formed thickly, resulting in that it was not possible to sufficiently obtain the powdering resistance, the chipping resistance, the plastic deformability, and the corrosion resistance after coating.

In test No. 40, the Si concentration of the plating bath was insufficient, so that the intermetallic compound layer was grown right after the steel sheet was immersed into the plating bath, and the intermetallic compound layer was formed thickly, resulting in that it was not possible to sufficiently obtain the chipping resistance and the plastic deformability.

In test No. 43, the second cooling rate was excessive, so that the area fraction of the first structure was insufficient, resulting in that it was not possible to sufficiently obtain the chipping resistance, the plastic deformability, and the corrosion resistance after coating.

In test No. 44, the cooling after the plating treatment was performed to the room temperature at the cooling rate of 10° C./second, so that the area fraction of the first structure was insufficient, and the area fraction of the Zn phases was excessive, resulting in that it was not possible to sufficiently obtain the chipping resistance, the seizing resistance, the plastic deformability, and the corrosion resistance after coating.

In test No. 45, the Mg concentration of the plating bath was excessive relative to the Si concentration, so that the $MgZn_2$ phases being the intermetallic compound phases were excessively contained in the plating layer, resulting in that it was not possible to sufficiently obtain the chipping resistance and the plastic deformability.

In test No. 48, the Mg concentration of the plating bath was excessive relative to the Si concentration, so that the $MgZn_2$ phases being the intermetallic compound phases were excessively contained in the plating layer, resulting in that it was not possible to sufficiently obtain the chipping resistance and the plastic deformability.

As shown in Table 3, Table 7, and Table 11, in test No. 50, the period of time taken for performing the cooling at the second cooling rate was too long, so that the intermetallic compound layer was formed thickly, resulting in that it was not possible to sufficiently obtain the corrosion resistance after coating, the plastic deformability, the powdering resistance, and the chipping resistance. In test No. 58, the Al concentration of the plating bath was insufficient, so that the area fraction of the first structure was insufficient, and the intermetallic compound layer was formed thickly, resulting in that it was not possible to sufficiently obtain the seizing resistance, the plastic deformability, and the corrosion resistance after coating.

In test No. 60, the Si concentration of the plating bath was insufficient, so that the intermetallic compound layer was grown right after the steel sheet was immersed into the plating bath, and the intermetallic compound layer was formed thickly, resulting in that it was not possible to sufficiently obtain the powdering resistance, the chipping resistance, the plastic deformability, and the corrosion resistance after coating.

In test No. 66, the second cooling rate was excessive, so that the area fraction of the first structure was insufficient, resulting in that it was not possible to sufficiently obtain the chipping resistance, the plastic deformability, and the corrosion resistance after coating.

In test No. 67, the cooling after the plating treatment was performed to the room temperature at the cooling rate of 10° C./second, so that the area fraction of the first structure was insufficient, and the area fraction of the Zn phases was excessive, resulting in that it was not possible to sufficiently obtain the chipping resistance, the seizing resistance, the plastic deformability, and the corrosion resistance after coating.

In test No. 69, the Mg concentration of the plating bath was excessive relative to the Si concentration, so that the $MgZn_2$ phases being the intermetallic compound phases were excessively contained in the plating layer, resulting in that it was not possible to sufficiently obtain the chipping resistance and the plastic deformability.

As shown in Table 3, Table 7, and Table 11, in test No. 77, the cooling after the plating treatment was performed to the room temperature at the cooling rate of 10° C./second, so that the area fraction of the first structure was insufficient, and the area fraction of the Zn phases was excessive, resulting in that it was not possible to sufficiently obtain the chipping resistance, the seizing resistance, the plastic deformability, and the corrosion resistance after coating.

In test No. 86, the Al concentration of the plating bath was excessive, so that the intermetallic compound layer was formed thickly, resulting in that it was not possible to sufficiently obtain the powdering resistance, the chipping resistance, the plastic deformability, and the corrosion resistance after coating.

In test No. 90, the Mg concentration of the plating bath was excessive, so that the $MgZn_2$ phases being the intermetallic compound phases were excessively contained in the plating layer, resulting in that it was not possible to sufficiently obtain the powdering resistance, the chipping resistance, and the plastic deformability.

In test No. 92, the Al concentration of the plating bath was excessive, so that the intermetallic compound layer was formed thickly, resulting in that it was not possible to sufficiently obtain the powdering resistance, the chipping resistance, the plastic deformability, and the corrosion resistance after coating.

In test No. 93, the Si concentration was excessive, so that the plating layer contained a lot of Si phases, resulting in that it was not possible to sufficiently obtain the chipping resistance, the seizing resistance, and the plastic deformability.

A commercially available Zn plated steel sheet in test No. 94 had inferior seizing resistance and long-term corrosion resistance after coating.

An alloyed Zn plated steel sheet in test No. 95 had inferior performance regarding all of the powdering resistance, the chipping resistance, the plastic deformability, and the corrosion resistance after coating.

A Zn electroplated steel sheet in test No. 96 had inferior seizing resistance and corrosion resistance after coating, since the thickness of the plating layer thereof was small.

In test No. 97 to test No. 99 being comparative examples, the second cooling rate was excessive, so that the area fraction of the first structure was insufficient, resulting in that it was not possible to sufficiently obtain the powdering resistance, the chipping resistance, the plastic deformability, and the corrosion resistance after coating.

On the other hand, in the invention examples within the range of the present invention, it was possible to obtain the powdering resistance, the chipping resistance, the seizing resistance, the bending test results, and the corrosion resistance after coating, which were all excellent. From the above description, it can be understood that the plated steel sheet is very effective as a material and the like of a steel sheet for automobile on which hard working is performed.

Figure 3:
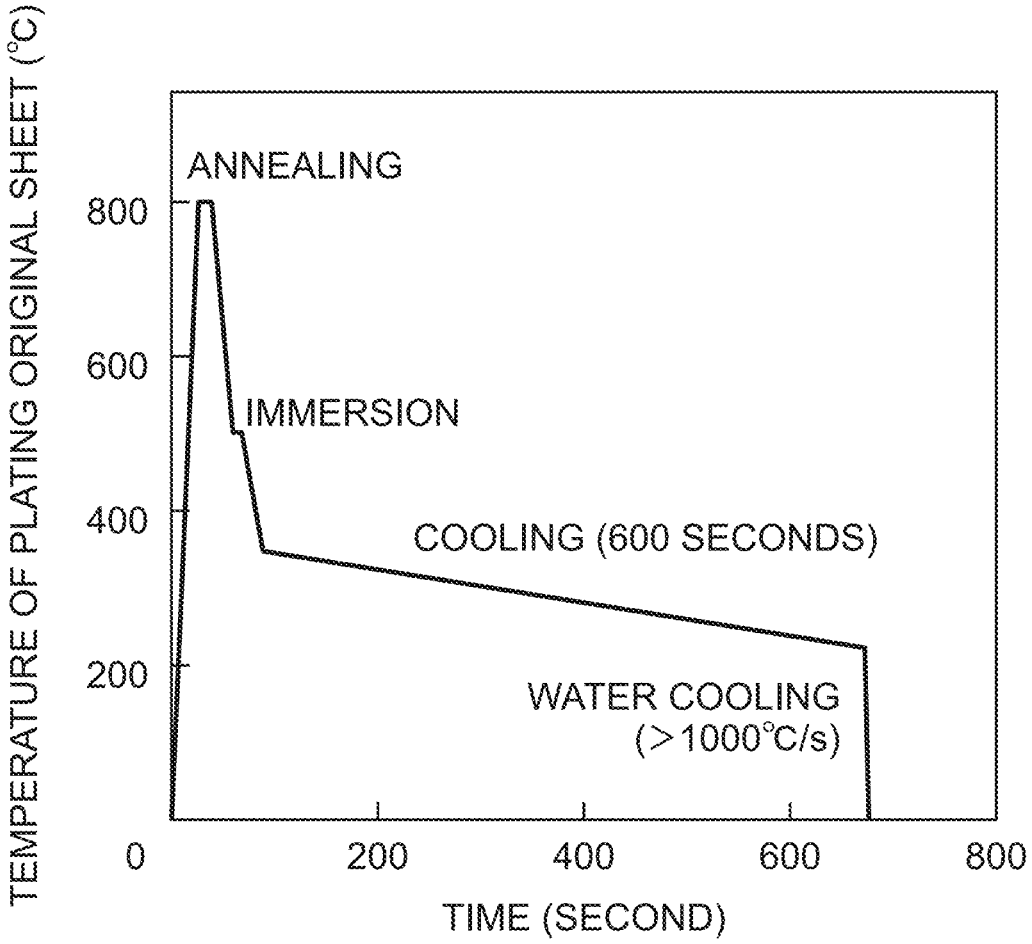
FIG. 3 is a view illustrating a change of temperature (heat pattern) of a plated steel sheet at a time of manufacturing a plated steel sheet of test No. 16 being an invention example.
Figure 4:
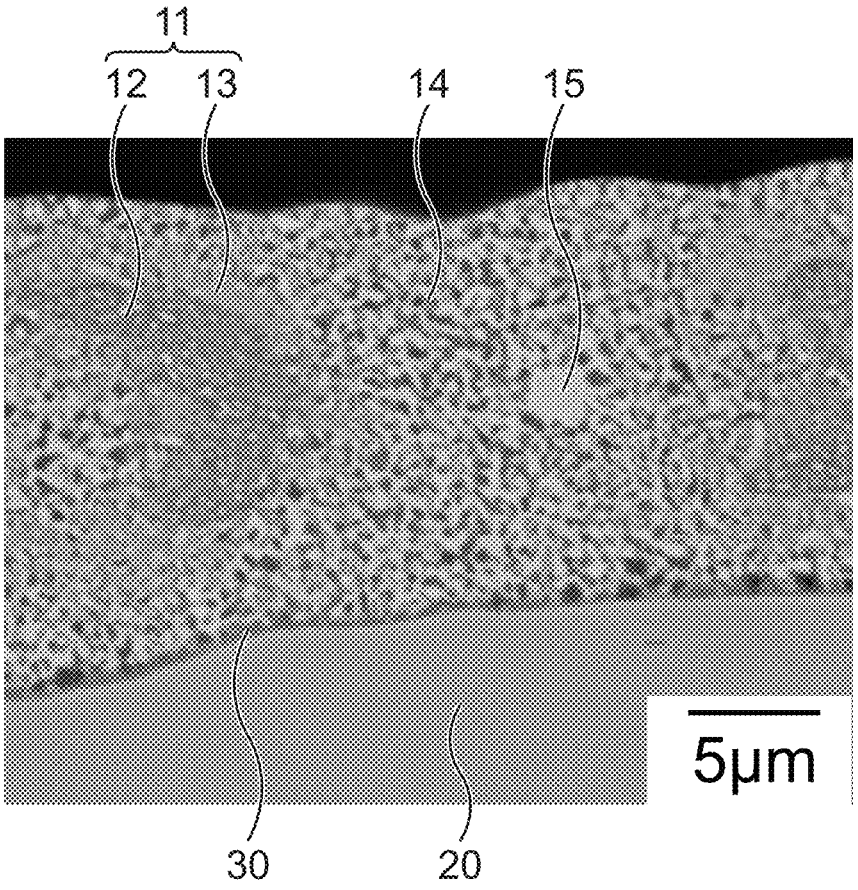
FIG. 4 is a view illustrating a BSE image of the plated steel sheet of test No. 16.
Figure 5:
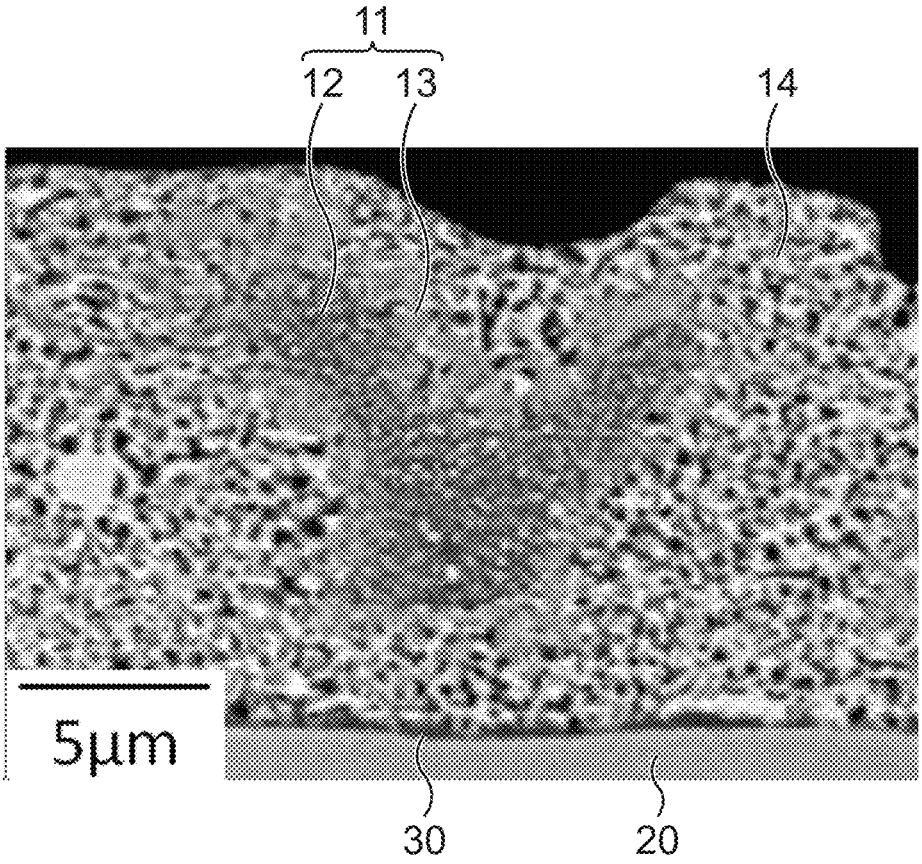
FIG. 5 is a view illustrating a BSE image of a plated steel sheet of test No. 91 being an invention example.

FIG. 3 illustrates a change of temperature (heat pattern) of a plated steel sheet at a time of manufacturing the plated steel sheet of test No. 16 being the invention example, and FIG. 4 illustrates a BSE image of the plated steel sheet of test No. 16. FIG. 5 illustrates a BSE image of the plated steel sheet of test No. 91 being the invention example. As illustrated in FIG. 4 and FIG. 5, in each of test No. 16 in which the Al concentration of the plating layer is 22%, and test No. 91 in which the Al concentration of the plating layer is 40%, the first structure 11, the eutectoid structure 14, and the Zn phases 15 exist at appropriate area fractions, and the second structure 12 and the third structure 13 are included in the first structure 11, in a similar manner to the embodiment illustrated in FIG. 1.

Figure 6:
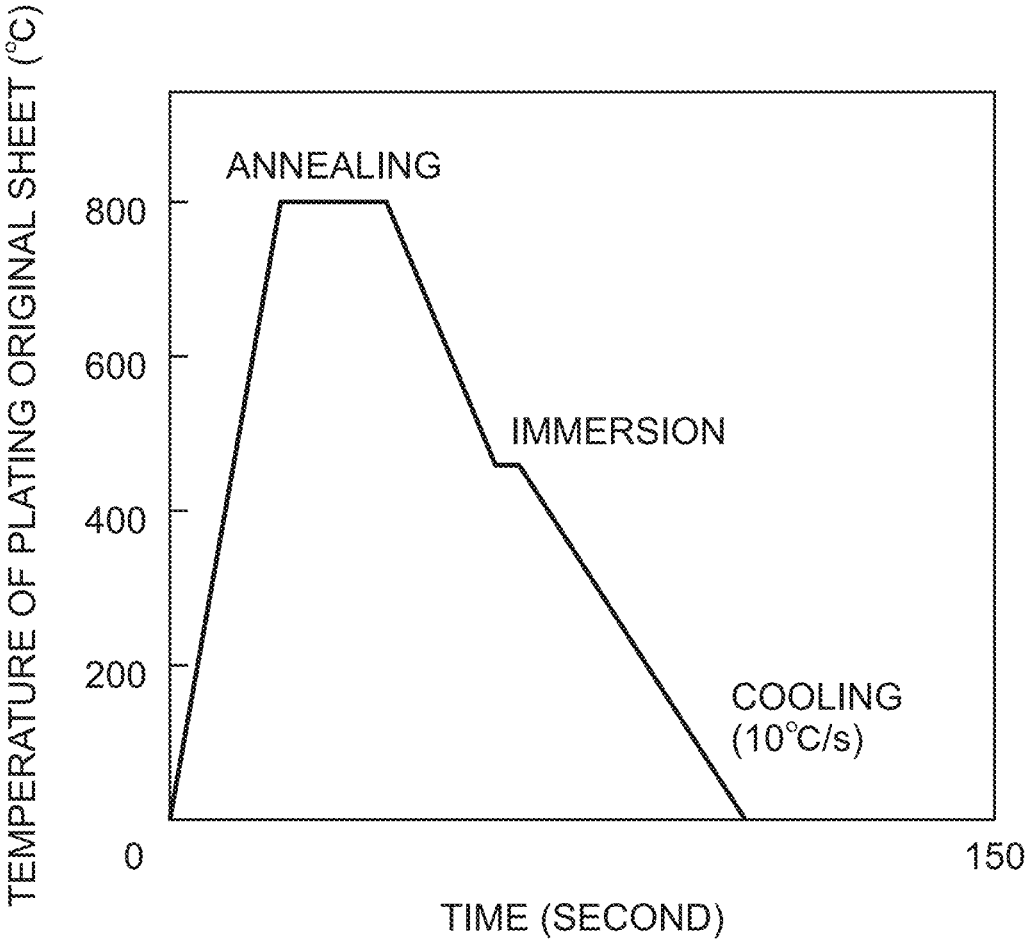
FIG. 6 is a view illustrating a change of temperature (heat pattern) of a plated steel sheet at a time of manufacturing a plated steel sheet of test No. 20 being a comparative example.
Figure 7:
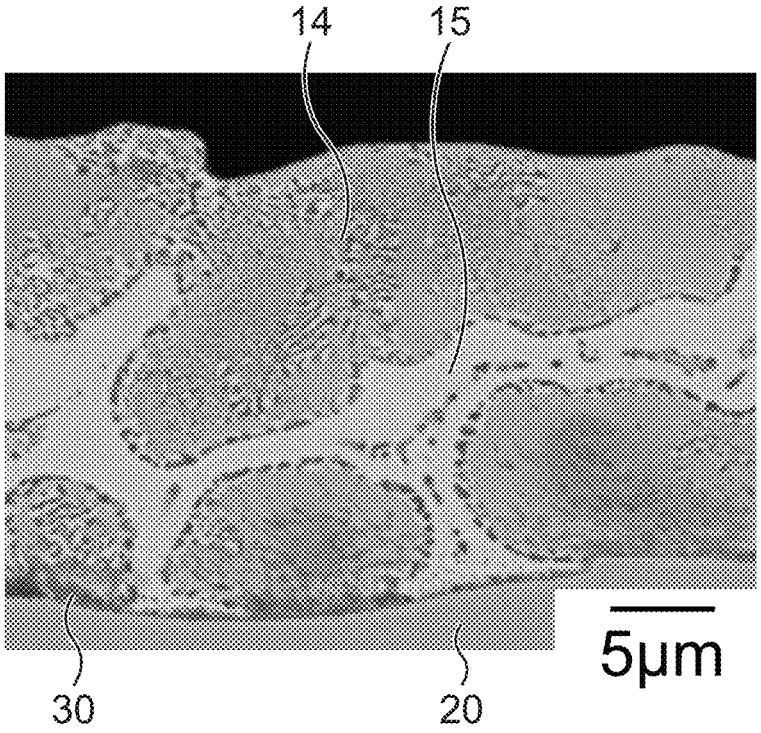
FIG. 7 is a view illustrating a BSE image of the plated steel sheet of test No. 20.

FIG. 6 illustrates a change of temperature (heat pattern) of a plated steel sheet at a time of manufacturing the plated steel sheet of test No. 20 being the comparative example, and FIG. 7 illustrates a BSE image of the plated steel sheet of test No. 20. As illustrated in FIG. 7, the first structure 11 did not exist, and the area fraction of the Zn phases 15 was high.

INDUSTRIAL APPLICABILITY

The present invention can be utilized in the industry related to a plated steel sheet suitable for an outer panel of an automobile, for example.

The invention claimed is:

1. A plated steel sheet, comprising an Al-containing Zn-based plating layer on at least a part of a surface of a steel sheet, wherein:

an average chemical composition of the plating layer and an intermetallic compound layer between the plating layer and the steel sheet is represented by, in terms of mass %, Al: 10% to 40%, Si: 0.05% to 4%, Mg: 0% to 5%, and the balance: Zn and impurities;

the plating layer includes:

a first structure constituted from Al phases containing Zn in solid solution and Zn phases dispersed in the Al phases and having an average chemical composition represented by, in terms of mass %, Al: 25% to 50%, Zn: 50% to 75%, and impurities: less than 2%; and a eutectoid structure constituted from Al phases and Zn phases and having an average chemical composition represented by, in terms of mass %, Al: 10% to 24%, Zn: 76% to 90%, and impurities: less than 2%;

in a cross section of the plating layer, an area fraction of the first structure is 5% to 40%, and a total area fraction of the first structure and the eutectoid structure is 50% or more;

an area fraction of Zn phases which are structures containing 90% or more of Zn, contained in the plating layer is 25% or less;

a total area fraction of intermetallic compound phases contained in the plating layer is 9% or less; and a thickness of the intermetallic compound layer is 2 μm or less.

2. The plated steel sheet according to claim 1, wherein a number density of the first structure on a surface of the plating layer is 1.6 pieces/$cm^2$ to 25.0 pieces/$cm^2$.

3. The plated steel sheet according to claim 1, wherein the first structure includes:

a second structure having an average chemical composition represented by, in terms of mass %, Al: 37% to 50%, Zn: 50% to 63%, and impurities: less than 2%; and a third structure having an average chemical composition represented by, in terms of mass %, Al: 25% to 36%, Zn: 64% to 75%, and impurities: less than 2%.

4. The plated steel sheet according to claim 1, wherein the average chemical composition of the plating layer and the intermetallic compound layer is represented by, in terms of mass %, Al: 20% to 40%, Si: 0.05% to 2.5%, Mg: 0% to 2%, and the balance: Zn and impurities.

5. The plated steel sheet according to claim 1, wherein the thickness of the intermetallic compound layer is 100 nm to 1000 nm.

6. The plated steel sheet according to claim 1, wherein in the cross section of the plating layer, the area fraction of the first structure is 20% to 40%, the area fraction of the eutectoid structure is 50% to 70%, and the total area fraction of the first structure and the eutectoid structure is 90% or more.

7. The plated steel sheet according to claim 1, wherein in the cross section of the plating layer, the area fraction of the first structure is 30% to 40%, the area fraction of the eutectoid structure is 55% to 65%, and the total area fraction of the first structure and the eutectoid structure is 95% or more.

8. The plated steel sheet according to claim 1, wherein:

in the average chemical composition of the plating layer and the intermetallic compound layer, the Mg concentration is 0.05% to 5%;

when the Mg concentration is set to Mg % and the Si concentration is set to Si %, a relationship of "Mg %≤2×Si %" is satisfied; and a crystal of $Mg_2Si$ which exists in the plating layer is 2 μm or less in terms of maximum equivalent circle diameter.

9. The plated steel sheet according to claim 1, wherein a volume fraction of the Zn phases contained in the plating layer is 20% or less.

* * * * *